US009636906B2

(12) United States Patent
Kawatoko et al.

(10) Patent No.: US 9,636,906 B2
(45) Date of Patent: May 2, 2017

(54) PRINTING APPARATUS AND DRIVING METHOD THEREFOR

(71) Applicant: CANON KABUSHIKI KAISHA, Tokyo (JP)

(72) Inventors: Norihiro Kawatoko, Yokohama (JP); Fumiko Suzuki, Kawasaki (JP); Yutaka Kano, Yokohama (JP); Yoshiyuki Honda, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/854,769

(22) Filed: Sep. 15, 2015

(65) Prior Publication Data

US 2016/0096363 A1 Apr. 7, 2016

(30) Foreign Application Priority Data

Oct. 7, 2014 (JP) ..... 2014-206671

(51) Int. Cl.

| | |
|---|---|
| ***B41J 2/045*** | (2006.01) |
| ***B41J 2/155*** | (2006.01) |
| ***B41J 2/21*** | (2006.01) |

(52) U.S. Cl.

CPC ..... *B41J 2/04505* (2013.01); *B41J 2/0451* (2013.01); *B41J 2/155* (2013.01); *B41J 2/2135* (2013.01); *B41J 2/2139* (2013.01); *B41J 2/2142* (2013.01); *B41J 2/2146* (2013.01)

(58) Field of Classification Search

CPC .. B41J 2/04501; B41J 2/04505; B41J 2/0451; B41J 2/04558; B41J 2/04573; B41J 2/155

See application file for complete search history.

(56) References Cited

U.S. PATENT DOCUMENTS

| | | | |
|---|---|---|---|
| 6,164,754 | A | 12/2000 | Ide et al. |
| 6,334,659 | B1 | 1/2002 | Maeda et al. |
| 6,364,446 | B1 | 4/2002 | Ishikawa et al. |
| 6,557,982 | B2 | 5/2003 | Murakami et al. |
| 6,572,212 | B2 | 6/2003 | Konno et al. |
| 6,580,460 | B1 | 6/2003 | Takahashi et al. |

(Continued)

FOREIGN PATENT DOCUMENTS

| | | | |
|---|---|---|---|
| JP | 2005-138374 | A | 6/2005 |
| JP | 2010-105203 | A | 5/2010 |
| JP | 2012-30594 | A | 2/2012 |

*Primary Examiner* — Kristal Feggins
*Assistant Examiner* — Kendrick Liu
(74) *Attorney, Agent, or Firm* — Fitzpatrick, Cella, Harper & Scinto

(57) ABSTRACT

A printing apparatus comprising a printhead including two nozzle arrays neighboring in a first direction, each array including nozzles arrayed in a second direction, a determining unit for determining discharge nozzles and non-discharge nozzles for each array, a conveying unit for conveying a sheet to the first direction, a unit configured to perform (a) determining printing data such that dots corresponding to the non-discharge nozzles in one array are printed by the discharge nozzles in another array, (b) inserting null data into the printing data based on a shift amount of between printing positions of the two nozzle array, and (c) newly determining discharge nozzles and non-discharge nozzles by the determining unit based on the printing data including the null data.

15 Claims, 23 Drawing Sheets

(56) References Cited

U.S. PATENT DOCUMENTS

| | | | |
|---|---|---|---|
| 6,644,770 | B1 | 11/2003 | Niimura et al. |
| 6,729,709 | B2 | 5/2004 | Konno et al. |
| 6,733,100 | B1 | 5/2004 | Fujita et al. |
| 6,808,247 | B2 | 10/2004 | Kawatoko et al. |
| 6,827,413 | B1 | 12/2004 | Kawatoko et al. |
| 6,921,218 | B2 | 7/2005 | Moriyama et al. |
| 6,957,880 | B2 | 10/2005 | Kawatoko et al. |
| 6,960,036 | B1 | 11/2005 | Fujita et al. |
| 7,048,351 | B2 | 5/2006 | Kawatoko |
| 7,057,756 | B2 | 6/2006 | Ogasahara et al. |
| 7,290,855 | B2 | 11/2007 | Chikuma et al. |
| 7,296,872 | B2 | 11/2007 | Hayashi et al. |
| 7,325,900 | B2 | 2/2008 | Hayashi et al. |
| 7,344,219 | B2 | 3/2008 | Sakamoto et al. |
| 7,600,835 | B2 | 10/2009 | Moriyama et al. |
| 7,618,116 | B2 | 11/2009 | Hamasaki et al. |
| 7,706,023 | B2 | 4/2010 | Kanda et al. |
| 7,959,246 | B2 | 6/2011 | Hamasaki et al. |
| 8,287,074 | B2 | 10/2012 | Kano et al. |
| 8,384,944 | B2 | 2/2013 | Kawatoko et al. |
| 8,430,472 | B2 | 4/2013 | Nishikori et al. |
| 8,444,246 | B2 | 5/2013 | Muro et al. |
| 8,608,271 | B2 | 12/2013 | Murayama et al. |
| 8,622,538 | B2 | 1/2014 | Miyakoshi et al. |
| 8,675,250 | B2 | 3/2014 | Muro et al. |
| 8,757,754 | B2 | 6/2014 | Azuma et al. |
| 8,864,266 | B2 | 10/2014 | Suzuki et al. |
| 8,876,280 | B2 | 11/2014 | Ishikawa et al. |
| 8,955,956 | B2 | 2/2015 | Yamamoto et al. |
| 8,979,238 | B2 | 3/2015 | Nishikori et al. |
| 9,004,640 | B2 | 4/2015 | Ishikawa et al. |
| 9,016,821 | B2 | 4/2015 | Masuda et al. |
| 9,039,112 | B2 | 5/2015 | Murayama et al. |
| 9,079,421 | B2 | 7/2015 | Kato et al. |
| 9,108,403 | B2 | 8/2015 | Kawatoko et al. |
| 9,138,989 | B2 | 9/2015 | Kawatoko et al. |
| 9,174,436 | B2 | 11/2015 | Suzuki et al. |
| 2009/0009543 | A1* | 1/2009 | Arazaki ..... B41J 29/393 347/9 |
| 2011/0310152 | A1 | 12/2011 | Muro et al. |
| 2012/0050375 | A1 | 3/2012 | Kano et al. |
| 2012/0274951 | A1 | 11/2012 | Nishikori et al. |
| 2015/0284202 | A1 | 10/2015 | Asano et al. |

* cited by examiner

FIG. 5A
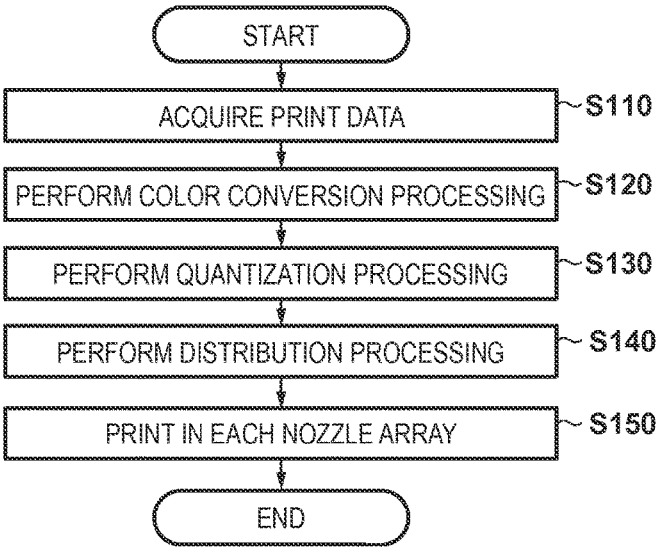
FIG. 5C
| Lv | NUMBER OF DOTS |
|---|---|
| 0 | 0 |
| 1 | 1 |
| 2 | 2 |
| 3 | 3 |
FIG. 5B
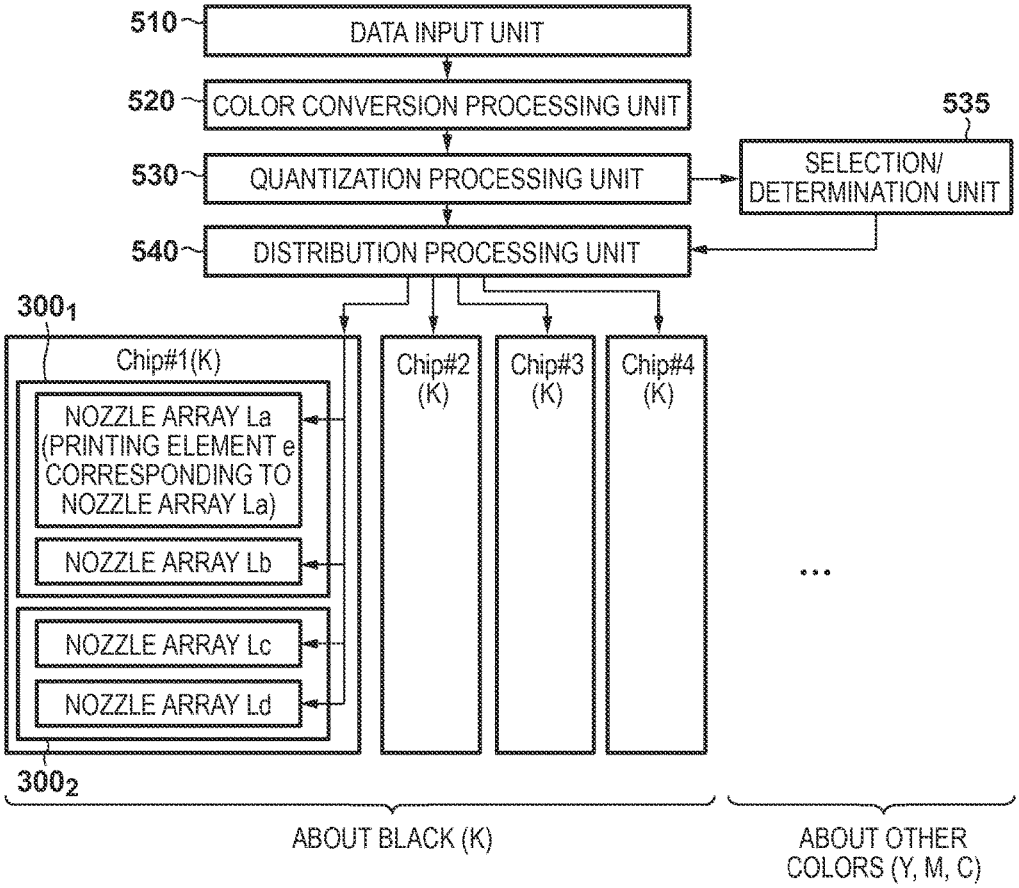

FIG. 7C

X (CONVEYING DIRECTION)

Y (NOZZLE ARRAY DIRECTION)

| B# | clm1 | clm2 | clm3 | clm4 |
|---|---|---|---|---|
| 1 | cda | dab | abc | bcd |
| 2 | dac | abd | bca | cdb |
| 3 | acd | bda | cab | dbc |
| 4 | cda | dab | abc | bcd |
| 5 | dab | abc | bcd | cda |
| 6 | abd | bca | cdb | dac |
| 7 | bda | cab | dbc | acd |
| 8 | dab | abc | bcd | cda |
| 9 | abc | bcd | cda | dab |
| 10 | bca | cdb | dac | abd |
| 11 | cab | dbc | acd | bda |
| 12 | abc | bcd | cda | dab |
| 13 | bcd | cda | dab | abc |
| 14 | cdb | dac | abd | bca |
| 15 | dbc | acd | bda | cab |
| 16 | bcd | cda | dab | abc |

TP1

PRINTING APPARATUS AND DRIVING METHOD THEREFOR

BACKGROUND OF THE INVENTION

Field of the Invention

The present invention relates to a printing apparatus and a driving method therefor.

Description of the Related Art

A printing apparatus includes, for example, a printhead for printing dots on a printing medium, and a conveying roller for conveying the printing medium. For example, in an arrangement in which printing is executed on a printing medium such as a longitudinally long-shaped sheet (roll sheet) while conveying the printing medium, the frictional force between the conveying roller and the printing medium can change due to a change in environment such as heat and humidity. Therefore, the conveying speed of the printing medium may change while printing is executed by conveying the printing medium. This may cause a print position shift by the printhead, thereby degrading the image quality.

Japanese Patent Laid-Open No. 2005-138374 exemplifies a method of correcting the timing of printing of dots in accordance with a change in conveying speed. An example of a method of correcting the timing of printing of dots is a method of delaying printing timings by some nozzle arrays by inserting null data to print data, and synchronizing the printing timings with those by the remaining nozzle arrays. This method is advantageous in improving the image quality since a print position shift caused by a change in conveying speed is corrected.

In some printing apparatuses, a printhead includes two or more nozzle arrays which are used to print dots of the same color and each of which has a plurality of nozzles arranged along a predetermined direction. Print data are distributed to the respective nozzle arrays, and the respective nozzle arrays are simultaneously driven based on the distributed print data. This arrangement is advantageous in improving the print speed since the two or more nozzle arrays are driven in parallel to print dots according to the print data.

Japanese Patent Laid-Open No. 2012-30594 (e.g. FIG. 8C) discloses a technique in which the nozzles of each group of two nozzle arrays are time-divisionally driven, and each nozzle array is time-divisionally driven by shifting the driving timings by a ½ period of time-divisional driving. Similarly, Japanese Patent Laid-Open No. 2012-30594 (e.g. FIG. 11C) discloses a technique in which the nozzles of each group of four nozzle arrays are time-divisionally driven, and each nozzle array is time-divisionally driven by shifting the driving timings by a ¼ period of time-divisional driving.

In the arrangement described in Japanese Patent Laid-Open No. 2012-30594, however, when the conveying speed of a printing medium is increased to improve the throughput, it is necessary to increase the operation speed of each nozzle array (for example, the driving frequency of each nozzle array) so that dots are appropriately printed on the printing medium at a speed corresponding to the conveying speed. This requires the user to change the design of hardware such as the circuit design of a printing apparatus along with a change in operation speed, leading to an increase in manufacturing cost.

SUMMARY OF THE INVENTION

The present invention provides a technique for a new driving method of two or more nozzle arrays, which is advantageous in correcting a print position shift while improving the throughput of a printing apparatus by increasing the conveying speed of a printing medium.

One of the aspects of the present invention provides a printing apparatus, comprising a printing unit including at least two nozzle arrays arranged in a first direction, each nozzle array including a plurality of nozzles arranged along a second direction intersecting the first direction, a conveying unit configured to convey, in the first direction, a sheet to be printed, a driving unit configured to drive the printing unit so as to print an image corresponding to print data on the sheet conveyed by the conveying unit and print, on the sheet, an adjusting pattern for acquiring a print position shift amount of a dot in the first direction between the nozzle arrays at a predetermined interval, a reading unit configured to read a printing result by the printing unit on the downstream side of a conveying direction of the sheet with respect to the printing unit, an acquisition unit configured to acquire the print position shift amount between the nozzle arrays based on a result of reading, by the reading unit, the adjusting pattern printed on the sheet while the conveying unit conveys the sheet, and a print data generation unit configured to generate the print data, wherein the print data generation unit performs a first operation of expanding print data onto a memory in correspondence with the first direction and the second direction, a second operation of, in each nozzle array for every column data corresponding to the second direction in the expanded print data, determining some of the plurality of nozzles as non-discharge nozzles so the nozzles do not overlap each other between the nozzle arrays in the first direction, and the remaining nozzles of the plurality of nozzles as discharge nozzles, a third operation of determining print data to be assigned to each nozzle array so that printing of dots corresponding to each column data is completed by printing dots corresponding to the determined non-discharge nozzles of a given nozzle array of the plurality nozzle arrays by the determined discharge nozzles of another nozzle array of the plurality of nozzle arrays, a fourth operation of inserting null data as column data corresponding to the print position shift amount acquired by the acquisition unit to the determined print data, and a fifth operation of distributing the print data to the respective nozzle arrays so as to newly determine discharge nozzles and non-discharge nozzles in response to insertion of the column data of the null data, and print, by the newly determined discharge nozzles, dots corresponding to the print data to which the column data has been inserted.

Further features of the present invention will become apparent from the following description of exemplary embodiments with reference to the attached drawings.

BRIEF DESCRIPTION OF THE DRAWINGS

FIGS. 5A to 5C are views for explaining an example of a print data processing method;

FIGS. 7A to 7C are views for explaining an example of the print data processing method;

DESCRIPTION OF THE EMBODIMENTS

1. Example of Arrangement of Printing Apparatus

Figure 1:
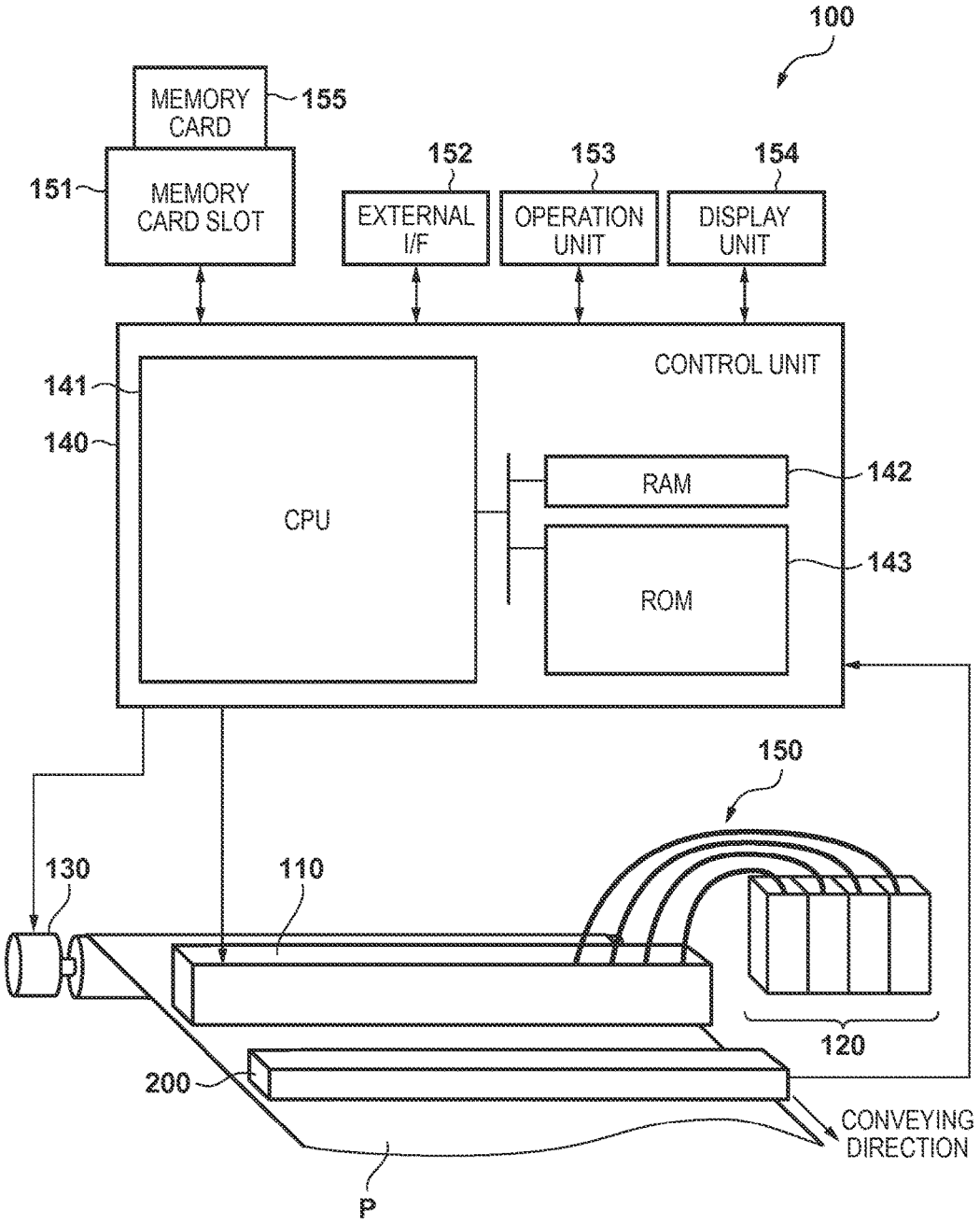
FIG. 1 is a view for explaining an example of the overall arrangement of a printing apparatus.

FIG. 1 is a schematic view for explaining an example of the overall arrangement of an inkjet printing apparatus 100 (to be also simply referred to as an "apparatus 100" hereinafter). The apparatus 100 includes a printhead 110 for printing on a printing medium, ink cartridges 120 for supplying inks (printing agents) to the printhead 110, a conveying roller 130 for conveying the printing medium, and a control unit 140. For example, a longitudinally long-shaped roll sheet P (to be also simply referred to as a "sheet P" hereinafter) can be used as a printing medium.

A plurality of nozzles are arranged along a predetermined direction in the printhead 110, and ink dots (dots) are printed on the sheet P by discharging ink droplets from the nozzles. The printhead 110 adopts a so-called full-line arrangement, and can perform printing at the full width (for example, about 18 inches) on the sheet P at once.

When the apparatus 100 supports color printing, the ink cartridges 120 are provided in correspondence with respective colors (for example, yellow (Y), magenta (M), cyan (C), and black (K)). In this example, the four ink cartridges 120 are provided. Ink in each ink cartridge 120 is supplied to the printhead 110 via, for example, an ink inlet pipe 150. Note that the color types and the number of colors are not limited to those in this example.

The conveying roller 130 conveys the sheet P in a direction intersecting the array direction of the plurality of nozzles in the printhead 110. In this specification, the array direction of the nozzles will be simply referred to as a "nozzle array direction" hereinafter, and the conveying direction of the sheet P will be simply referred to as a "conveying direction" hereinafter.

Note that only the conveying roller 130 is shown for the sake of simplicity. The apparatus 100 may further include other conveying units. For example, the apparatus 100 includes a paper feed unit for feeding the sheet P to a path for executing printing on the sheet P and each process associated with printing, a plurality of conveying rollers for conveying the sheet P from the paper feed unit, and a plurality of motors for driving the plurality of conveying rollers.

The control unit 140 includes, for example, a CPU 141 and a memory such as a RAM 142 and ROM 143, and controls the respective units of the apparatus 100 based on, for example, a print job including a control command and print data. More specifically, for example, the CPU 141 reads out a program for printing from the ROM 143 and expands it onto the RAM 142, and also expands print data onto the RAM 142, thereby performing data processing based on the program for the print data. The CPU 141 drives the conveying roller 130 while driving the printhead 110 based on the print data having undergone the data processing.

Note that upon start of printing based on the print data having undergone the above data processing, before the printing is completed, preparations for printing based on next print data are started by expanding the next print data onto the RAM 142, and performing the same data processing. By repeating this operation, one or more images corresponding to a print job input to the apparatus 100 are formed on the sheet P without interrupting a print operation.

With the above arrangement, while the sheet P is conveyed in the conveying direction, dots are printed on the sheet P by the respective nozzles of the printhead 110, and images corresponding to the print data are formed on the sheet P. Note that in this specification, an "image" can include a region such as a blank where no dots are printed, in addition to characters, graphics, symbols, and other objects formed by one or more dots, which are formed in an effective region of the roll sheet P. An image formed in a region corresponding to a unit page of the roll sheet P will also be referred to as an "image for one page" or "unit image" hereinafter.

The apparatus 100 further includes a scanner 200 arranged on the downstream side of the conveying direction with respect to the printhead 110. The scanner 200 functions as an inspection unit for inspecting an image formed on the sheet P, and can also function as a reading unit for reading a predetermined test pattern. A CCD or CMOS line sensor or another known optical sensor is used as the scanner 200. Note that the scanner 200 need only be located on the downstream side of the conveying direction with respect to the printhead 110 when the apparatus 100 executes printing, and need not be located on the downstream side while the apparatus 100 executes no printing.

The apparatus 100 may further include a memory card slot 151, an external interface (external I/F) 152, an operation unit 153, and a display unit 154. These units are connected to the control unit 140 via, for example, a system bus, and can exchange print data or a control command. For example, a memory card 155 is inserted to the memory card slot 151, and the control unit 140 can read out print data held in the memory card 155, and perform control based on the print data. For example, the control unit 140 may receive print data via the external interface 152, and control each unit based on the print data. Furthermore, for example, the user can set print information via the operation unit 153, and the control unit 140 may control each unit based on the information. The display unit 154 can display a print status and the state of the apparatus 100, as needed, and the user can refer to the display unit 154.

Figure 2A:
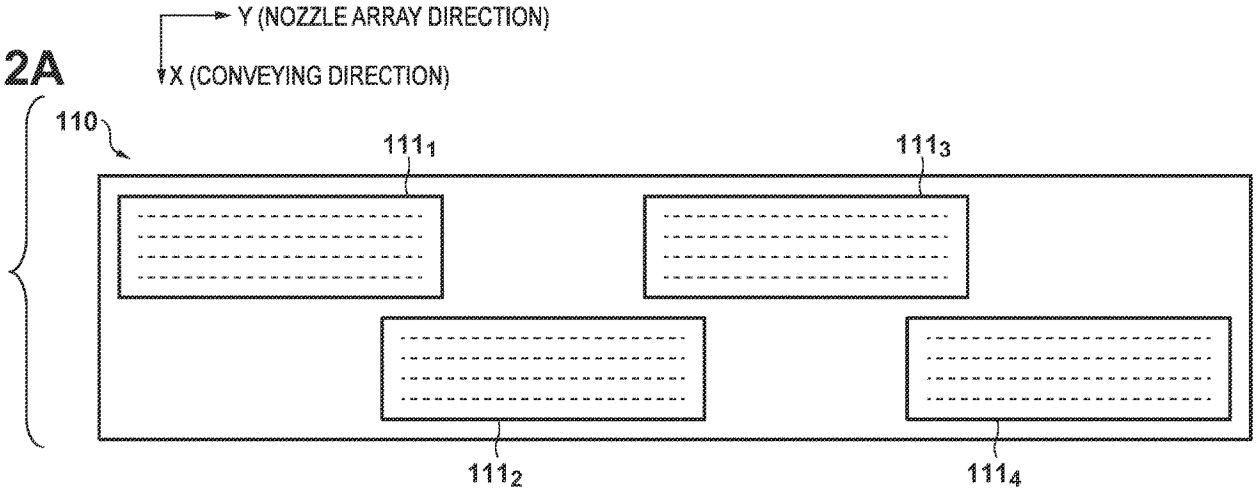
FIGS. 2A and 2B are views for explaining an example of the arrangement of a full-line printhead.
Figure 2B:
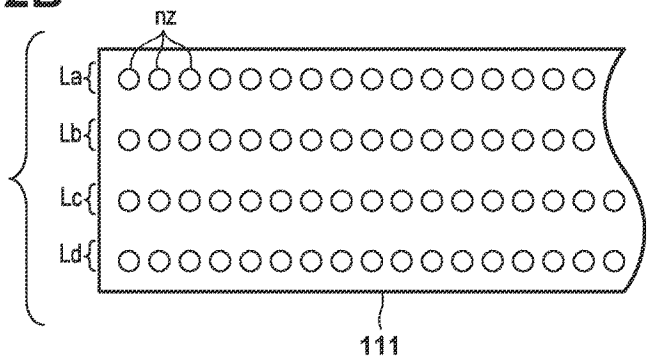

FIGS. 2A and 2B are schematic views for explaining a portion, corresponding to one color (for example, K), of an example of the arrangement of the printhead 110. As exemplified in FIG. 2A, a plurality of nozzle substrates 111 such as $\mathbf{111}_1$ are arranged in a staggered pattern on the surface of the printhead 110, which is used to perform printing. As exemplified in FIG. 2B, four nozzle arrays L, that is, La to Ld for printing dots of the same color (in this example, K) are provided in each nozzle substrate 111. Each nozzle array L includes a plurality of nozzles nz arranged at predetermined pitches (for example, 1,200 dpi) in a direction intersecting the conveying direction of the sheet P. Referring to FIGS. 2A and 2B, the conveying direction of the sheet P is represented by "X" and the nozzle array direction is represented by "Y". The full-line printhead 110 is formed to have such arrangement. Note that the number of nozzle arrays L and the number of nozzle substrates 111 are not limited to those in this example. Although the four nozzle arrays L have been exemplified for one color (K) for the sake of simplicity, the same applies to the remaining three colors (Y, M, and C).

Figure 3:
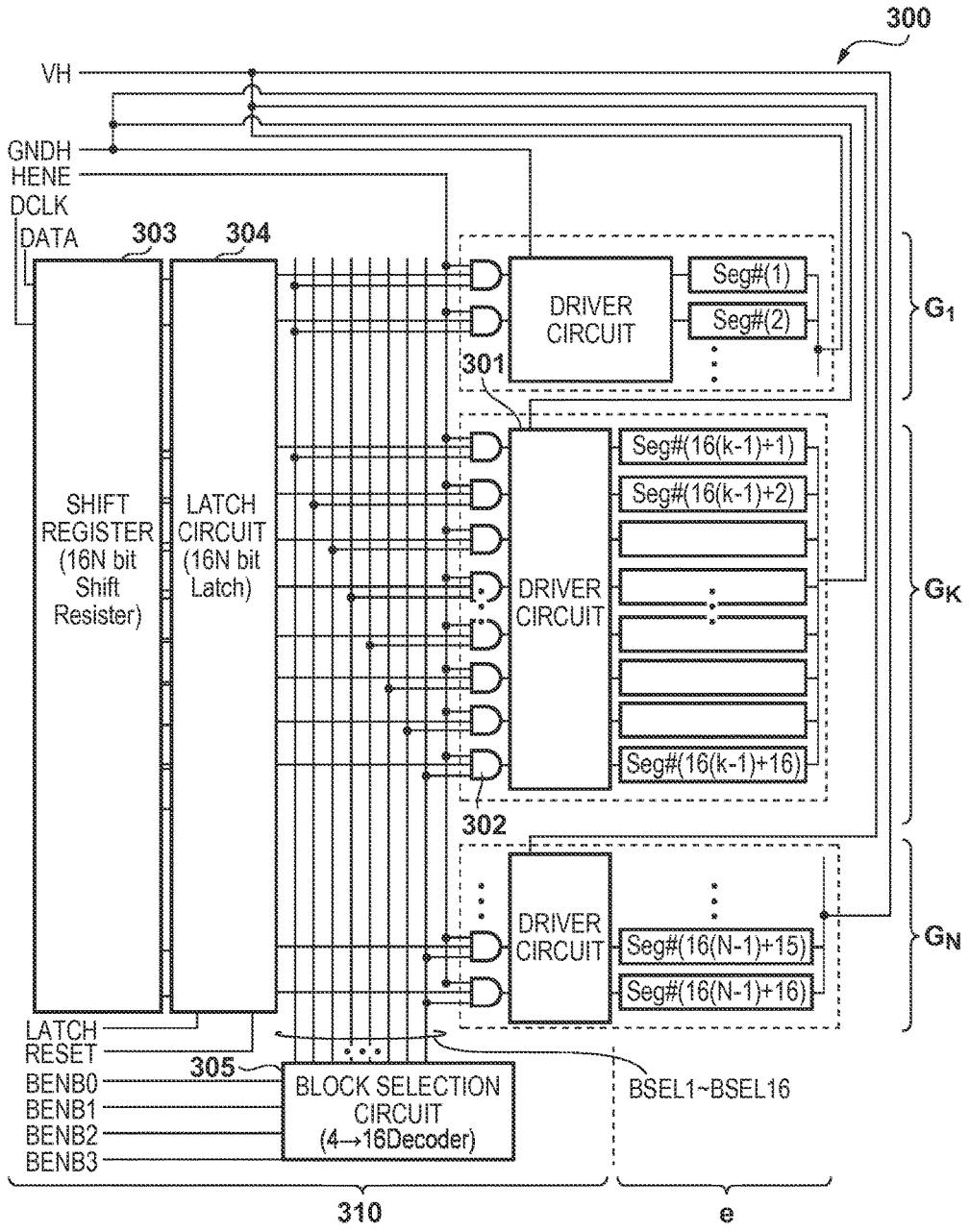
FIG. 3 is a view for explaining an example of the arrangement of a printing element substrate.

FIG. 3 shows an example of the arrangement of a printing element substrate 300 (to be simply referred to as an "element substrate 300" hereinafter). Element substrates $\mathbf{300}_1$, $\mathbf{300}_2$, $\mathbf{300}_3$, and $\mathbf{300}_4$ corresponding to the nozzle arrays La, Lb, Lc, and Ld are provided in the printhead 110. Note that the element substrates $\mathbf{300}_1$, $\mathbf{300}_2$, $\mathbf{300}_3$, and $\mathbf{300}_4$ can be provided for each nozzle substrate 111. Note that in this specification, when the element substrates $\mathbf{300}_1$, $\mathbf{300}_2$, $\mathbf{300}_3$, and $\mathbf{300}_4$ are not specifically discriminated, they are simply referred to as the "element substrates 300".

The element substrate 300 includes a plurality of printing elements e and a logic circuit 310 for driving the plurality of printing elements e. Each of the plurality of printing elements e corresponds to each nozzle nz, and an electrothermal transducer (heater) can be used as each printing element e. The logic circuit 310 specifically includes driver circuits 301, AND circuits 302, a shift register 303, a latch circuit 304, and a block selection circuit 305. In accordance with a signal from the logic circuit 310, each printing element e is driven to generate heat energy, and the corresponding nozzle nz discharges an ink droplet by the heat energy. This is also expressed as "the nozzle is driven".

The plurality of printing elements e are divided into N groups G, that is, $G_1$ to $G_N$ so that each group includes 16 printing elements e (N is an integer of 2 or more). More specifically, a segment number (Seg#) is assigned to each of the plurality of printing elements e, and a given group $G_k$ includes 16 printing elements e of Seg#(16(k−1)+1) to Seg#(16(k−1)+16) (k is an integer of 1 to N).

The element substrate $\mathbf{300}_1$ corresponding to the nozzle array La will be exemplified. In this case, among the 16 printing elements e of the group $G_k$, the 16 printing elements e of Seg#(16(k−1)+1), Seg#(16(k−1)+2), . . . , Seg#(16(k−1)+16) correspond to the nozzles nz of the nozzle array La.

Block numbers B#1 to B#16 are also assigned to the 16 printing elements e, respectively. For example, in the group $G_k$, the printing element e of Seg#(16(k−1)+1) belonging to the nozzle array La or the like is assigned with B#1. That is, B#1: Seg#(16(k−1)+1)

Similarly,

B#2: Seg#(16(k−1)+2)
B#3: Seg#(16(k−1)+3)
B#4: Seg#(16(k−1)+4)
B#5: Seg#(16(k−1)+5)
B#6: Seg#(16(k−1)+6)
B#7: Seg#(16(k−1)+7)
B#8: Seg#(16(k−1)+8)
B#9: Seg#(16(k−1)+9)
B#10: Seg#(16(k−1)+10)
B#11: Seg#(16(k−1)+11)
B#12: Seg#(16(k−1)+12)
B#13: Seg#(16(k−1)+13)
B#14: Seg#(16(k−1)+14)
B#15: Seg#(16(k−1)+15)
B#16: Seg#(16(k−1)+16)

Similarly, segment numbers (Seg#) and block numbers (B#) are assigned to the corresponding nozzles nz.

Each of the printing elements e of each group G is driven for each block together with the corresponding printing elements e of other groups G. More specifically, the respective printing elements e of the same block number are simultaneously driven. For example, the printing element e of Seg#(1) of the group $G_1$ and that of Seg#(16(k−1)+1) of the group $G_k$ belong to the same block, that is, B#1, and are driven at substantially the same timing. The printing elements e belonging to the respective blocks are sequentially driven.

This driving method will also be referred to as "time-divisional driving" hereinafter, the block will also be referred to as a "time-divisional driving block" or simply a "time-divisional block" hereinafter, and the group will also be referred to as a "time-divisional driving group" or simply a "time-divisional group" hereinafter.

The shift register 303 is a 16×N-bit shift register, and sequentially shifts print data DATA every time a clock signal DCLK is received from the control unit 140.

The latch circuit 304 is a 16×N-bit latch circuit, and latches the 16×N-bit print data of the shift register 303 in response to a latch signal LATCH from the control unit 140. The latched data will also simply be referred to as "latch data" hereinafter. For example, the latch circuit 304 initializes the latch data upon receiving a reset signal RESET from the control unit 140.

The block selection circuit 305 functions as a decoder and, for example, generates a block selection signal BSEL, that is, BSEL1 to BSEL16 upon receiving block enable signals BENB0 to BENB3 from the control unit 140. The block selection signal BSEL is a control signal for selecting a specific block whose printing elements e are to be driven.

Each AND circuit 302 is provided in correspondence with each printing element e. Each AND circuit 302 receives the latch data of the latch circuit 304, the block selection signal BSEL, and a heat enable signal HENB for defining the driving time of the printing element e, and outputs a driving signal to the driver circuit 301.

A heater voltage VH and a ground voltage GNDH corresponding to it are supplied to the driver circuit 301, and the driver circuit 301 boosts the driving signal from the AND circuit 302 and supplies it to the printing element e. This drives the printing element e, that is, drives the corresponding nozzle nz to discharge an ink droplet.

Figure 4:
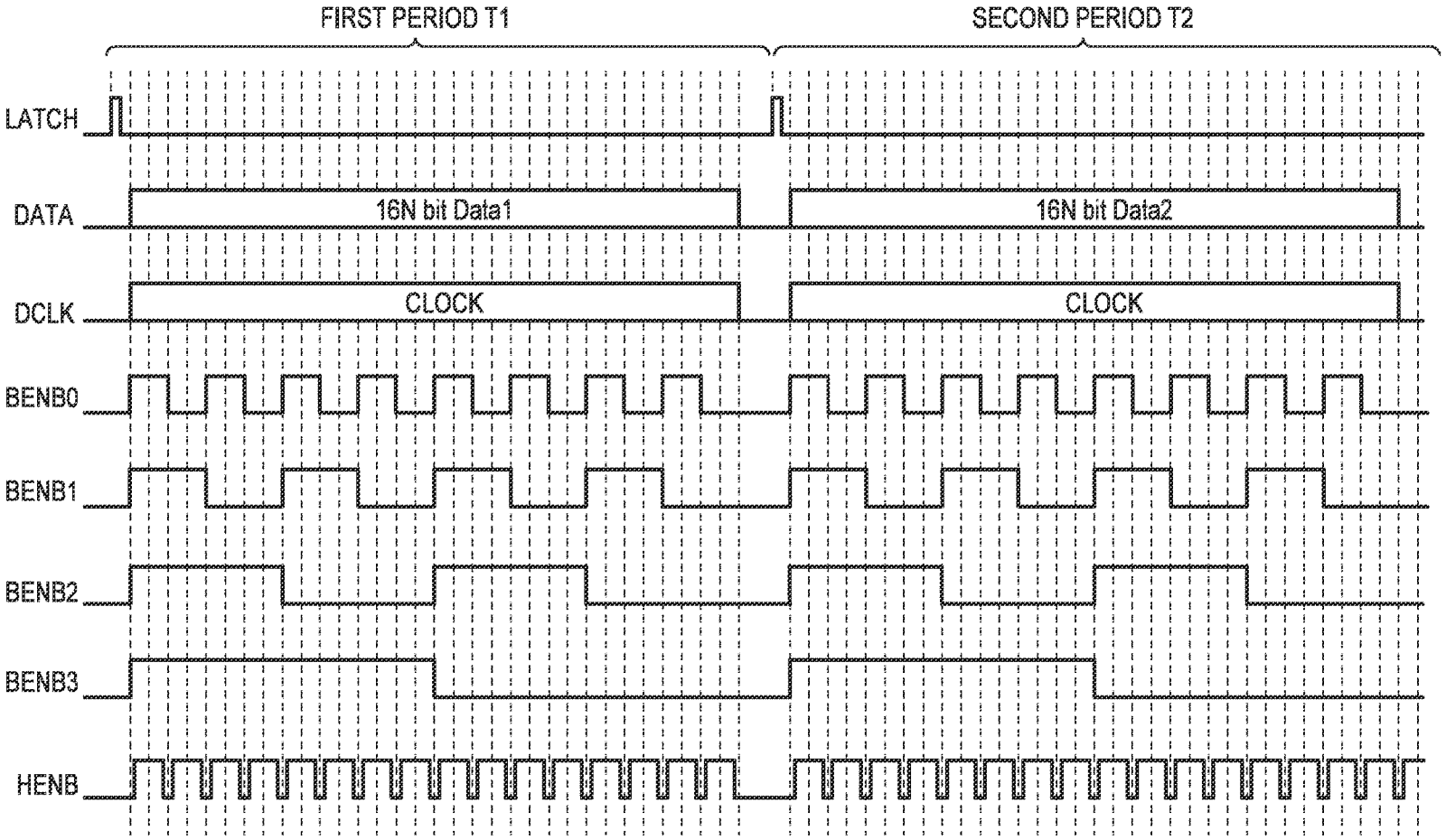
FIG. 4 is a timing chart for explaining an example of a driving method of the printing element substrate.

FIG. 4 shows a reference example of a timing chart for driving the element substrate 300. For example, during a first period T1, the latch signal LATCH is received, and the latch circuit 304 latches print data DATA1 corresponding to the period T1. After that, the block enable signal BENB0 is alternately set at high or low level in a predetermined cycle. During this period, the block enable signals BENB1 to BENB3 are alternately set at high or low level in cycles twice, four times, and eight times that of the signal BENB0, respectively. During the period T1, one of the 16 blocks, that is, B#1 to B#16 is sequentially selected. The selected printing element e is driven based on the print data DATA1.

Furthermore, during the period T1, the shift register 303 receives the clock signal DCLK, and shifts print data DATA2 for a second period T2. In response to the latch signal LATCH during the period T2, the latch circuit 304 latches the print data DATA2. After that, the same processing as that during the period T1 is performed.

2. First Embodiment

The first embodiment will be described below with reference to FIGS. 5A to 14.

2-1. Example of Driving Method of Printing Apparatus

FIGS. 5A to 5C are views for explaining an example of a print data processing method. FIG. 5A is a flowchart illustrating an example of the print data processing method. FIG. 5B is a block diagram for explaining a data flow corresponding to the flowchart.

In step S110 (to be simply referred to as "S110" hereinafter; the same applies to other steps), print data input from a data input unit 510 are acquired. More specifically, as described with reference to FIG. 1, the print data can be externally input via an external interface 152 or the like, and expanded onto a RAM 142 of a control unit 140 or the like. The obtained print data are 8-bit, 256-tone data for three colors of red (R), green (G), and blue (B).

In S120, a color conversion processing unit 520 performs color conversion processing (color space conversion processing) for the input print data. The print data are converted into 8-bit, 256-tone data for respective colors corresponding to ink colors. For example, in this example in which color printing is executed using four ink colors of Y (yellow), M (magenta), C (cyan), and K (black), data for the four colors of Y, M, C, and K are generated. The print data having undergone the color conversion processing undergoes data processing for each color.

In S130, a quantization processing unit 530 performs quantization processing for the print data for each color, which has undergone the color conversion processing. The quantization processing includes data processing by, for example, an error diffusion method or dither matrix method. Assuming that unit data corresponding to a given print position is a "pixel value" in the print data, the error diffusion method performs quantization processing for each pixel value in accordance with the difference from its peripheral pixel value. The print data can be converted into, for example, four-level data (one of levels 0 to 3) by the error diffusion method.

FIG. 5C shows the number of dots corresponding to each level value for the print data converted into the four-level data (one of levels 0 to 3). Referring to FIG. 5C, if, among the print data, data corresponding to a given print position is at level 1 (Lv1), one dot is printed at the print position. If data corresponding to a given print position is at level 2 (Lv2), two dots are printed at the print position. If data corresponding to a given print position is at level 3 (Lv3), three dots are printed at the print position. Furthermore, if data corresponding to a given print position is at level 0 (Lv0), no dot is printed at the print position. Note that if print data undergoes quantization processing and is converted into multi-level data, it is possible to increase the gamut of an image to be formed on the sheet P.

In S140, a distribution processing unit 540 performs distribution processing for the print data for the respective colors, which have undergone the quantization processing, thereby distributing the print data to the respective nozzle arrays L of the printhead 110. More specifically, the print data are distributed to the respective element substrates 300 so as to appropriately print dots by the corresponding nozzle arrays L.

The distribution processing unit 540 performs distribution processing based on a result of selection or determination by a selection/determination unit 535 and a detailed description thereof will be provided later. The selection/determination unit 535 selects or determines, among the plurality of nozzles nz, nozzles ("driving nozzles" or "discharge nozzles") which can be driven to perform printing according to the print data and nozzles ("non-driving nozzles" or "non-discharge nozzles") which are not driven, and determines specific ones of the driving nozzles, which are to be used for printing.

Note that as described above with reference to FIG. 2A, each nozzle array L is formed by the plurality of nozzle substrates 111 arranged in a staggered pattern. Therefore, between the two nozzle substrates 111 adjacent to each other in the conveying direction, portions of the two chips overlap each other in the conveying direction. In this case, the print data need only be distributed so that dots are printed by one of the overlapping portions.

In S150, the printhead 110 is driven based on the distributed print data to print dots on the sheet P by the respective nozzle arrays L.

Note that with respect to the above-described units 520 to 540, the control unit 140 may include dedicated arithmetic processing units corresponding to them or the CPU 141 may have functions corresponding to them. Also, the dedicated arithmetic processing unit corresponding to the units 520 to 540 or the unit having the functions corresponding to the units 520 to 540 may be referred to as a print data generation unit.

Figure 6:
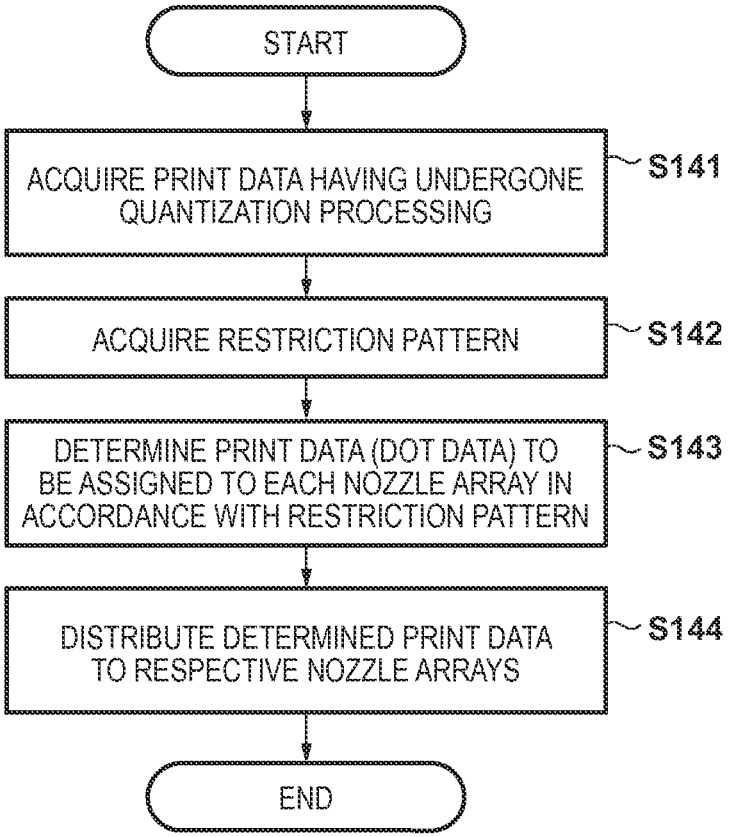
FIG. 6 is a flowchart for explaining an example of the print data processing method.

FIG. 6 is a flowchart for explaining details of the distribution processing in S140. In S141, the print data having undergone the quantization processing in S130 are acquired. In S142, restriction patterns each for defining driving nozzles and non-driving nozzles of the plurality of nozzles nz are acquired. After that, in S143, in accordance with the acquired restriction patterns, print data to be assigned to the respective nozzle arrays L are determined. Lastly, in S144, the determined print data are distributed to the nozzle arrays L. A practical example of the above flowchart will be described below with reference to FIGS. 7A to 7C, 8A, and 8B.

Figure 7A:
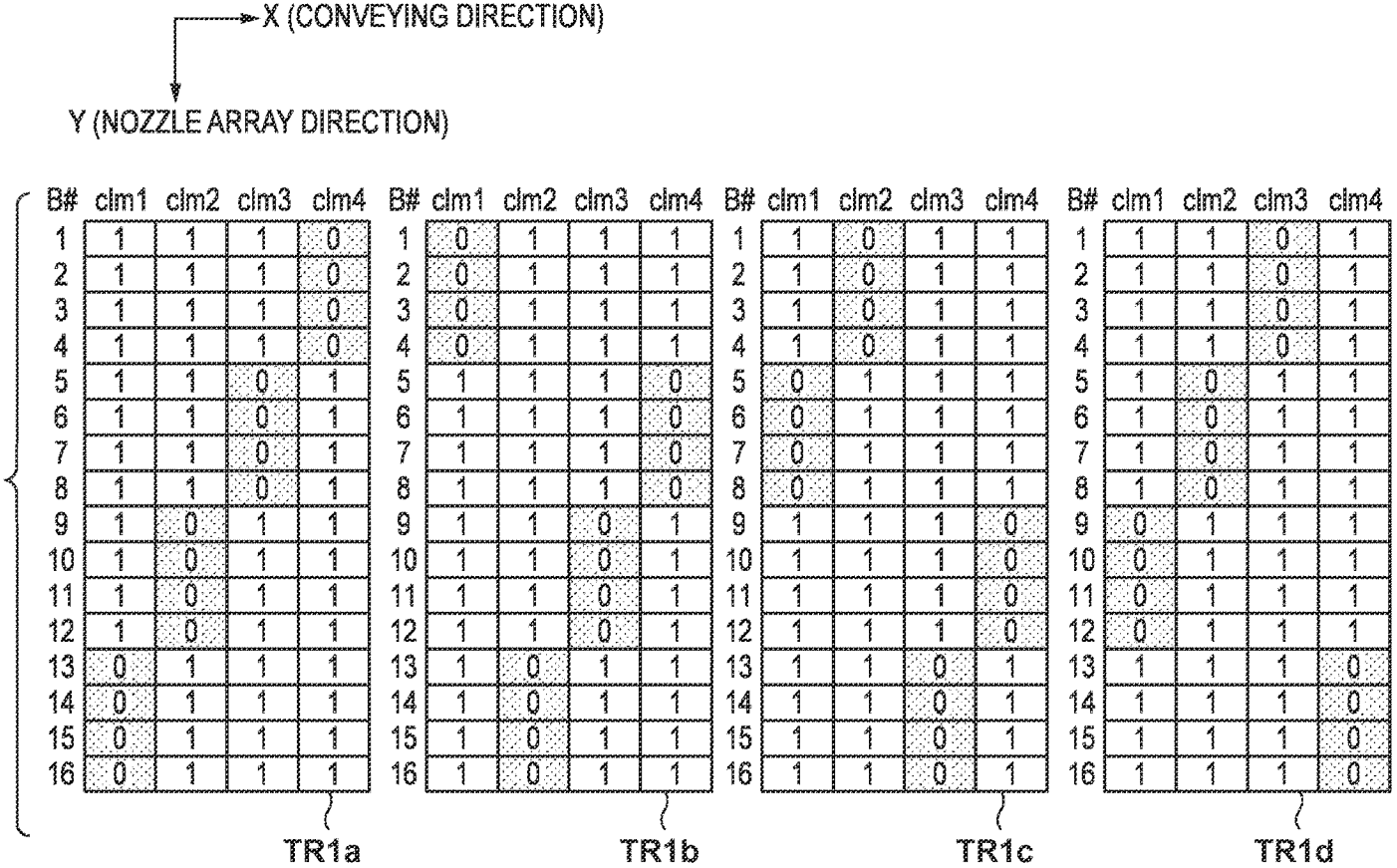

FIG. 7A is a view for explaining the restriction patterns each for defining driving nozzles and non-driving nozzles of the plurality of nozzles nz.

Assume that on the sheet P, a region where it is possible to print dots by driving all the driving nozzles once among the driving nozzles and non-driving nozzles is set as a "unit column". That is, assuming that the unit period of time-divisional driving is the time required to drive all the driving nozzles once, the unit column indicates a region where it is possible to print dots for one period of time-divisional driving, and can also indicate a region with a unit pixel width (for example, 1,200 dpi). Data for one column corresponding to the unit column in the print data will be referred to as "unit column data" or simply "column data" hereinafter. Each column data corresponds to the nozzle array direction Y.

For the sake of simplicity, restriction patterns each for four columns will be described using the block numbers B#1 to B#16.

Each restriction pattern defines driving nozzles and non-driving nozzles for every column unit. In other words, each restriction pattern is a reference table for selecting, for each column data of the print data, nozzles (that is, driving nozzles) which can be driven to print dots corresponding to the column data and nozzles (that is, non-driving nozzles) driving of which is limited. Each restriction pattern need only be stored in, for example, the ROM 143 (see FIG. 1), and can be expanded onto the RAM 142, as needed.

For example, with respect to a restriction pattern TR1*a* to be applied to the nozzle array La, in a first column clm1, the nozzles nz of B#1 to B#12 are driving nozzles and the nozzles nz of B#13 to B#16 are non-driving nozzles. To discriminate between the driving nozzles and the non-driving nozzles, the boxes of the non-driving nozzles are hatched in FIG. 7A.

Similarly, with respect to a restriction pattern TR1*b* to be applied to the nozzle array Lb, in the column clm1, the nozzles nz of B#5 to B#16 are driving nozzles and the nozzles nz of B#1 to B#4 are non-driving nozzles. With respect to a restriction pattern TR1*c* to be applied to the nozzle array Lc, in the column clm1, the nozzles nz of B#1 to B#4 and B#9 to B#16 are driving nozzles and the nozzles nz of B#5 to B#8 are non-driving nozzles. With respect to a restriction pattern TR1*d* to be applied to the nozzle array Ld, in the column clm1, the nozzles nz of B#1 to B#8 and B#13 to B#16 are driving nozzles and the nozzles nz of B#9 to B#12 are non-driving nozzles.

That is, some of the plurality of nozzles nz of each group G are selected as "non-driving nozzles" so the non-driving nozzles do not overlap each other between the nozzle arrays L in the conveying direction X, and the remaining nozzles are selected as "driving nozzles".

In this example, with respect to the column clm1, the nozzles nz of B#1 to B#4 in the nozzle array Lb are non-driving nozzles, and dots corresponding to these nozzles are printed by driving nozzles in at least one of the nozzle arrays La, Lc, and Ld. That is, in this example, with respect to the column clm1, dots corresponding to the nozzles nz of B#1 to B#4 are printed by the corresponding nozzles nz of at least one of the nozzle arrays La, Lc, and Ld.

Similarly, dots corresponding to the nozzles nz of B#5 to B#8 are printed by the corresponding nozzles nz of at least one of the nozzle arrays La, Lb, and Ld. Dots corresponding to the nozzles nz of B#9 to B#12 are printed by the corresponding nozzles nz of at least one of the nozzle arrays La, Lb, and Lc. Dots corresponding to the nozzles nz of B#13 to B#16 are printed by the corresponding nozzles nz of at least one of the nozzle arrays Lb, Lc, and Ld.

In a second column clm2, third column clm3, and fourth column clm4, the block numbers corresponding to the diving nozzles and non-driving nozzles are sequentially shifted by four. For example, with respect to the restriction pattern TR1*a*, the nozzles nz of B#9 to B#12 are non-driving nozzles in the column clm2, the nozzles nz of B#5 to B#8 are non-driving nozzles in the column clm3, and the nozzles nz of B#1 to B#4 are non-driving nozzles in the column clm4. The same applies to the restriction patterns TR1*b* to TR1*d*.

In summary, the "driving nozzles" selected based on the restriction pattern are the nozzles nz which can be driven to perform printing according to the print data. Therefore, for example, if the corresponding latch data (see FIG. 3) is at the high level, the driving nozzles are driven to print dots. On the other hand, if the latch data is at the low level, the driving nozzles are not driven and no dots are printed. Furthermore, the "non-driving nozzles" selected by the restriction pattern are the nozzles nz driving of which is limited. The non-driving nozzles are not driven regardless of whether the latch data is at the high or low level. Dots corresponding to the non-driving nozzles can be printed by the nozzles which correspond to the non-driving nozzles and are the driving nozzles in a nozzle array (for example, Lb to Ld) different from the nozzle array (for example, La) to which the non-driving nozzles belong. This completes printing of the dots corresponding to the print data.

Note that for example, if some nozzles nz are selected as driving nozzles, the remaining nozzles nz can be set as non-driving nozzles. Alternatively, if some nozzles nz are selected as non-driving nozzles, the remaining nozzles nz can be set as driving nozzles. That is, selection of driving nozzles and non-driving nozzles by the restriction pattern is substantially equivalent to selection of driving nozzles or non-driving nozzles by the restriction pattern.

Figure 7B:
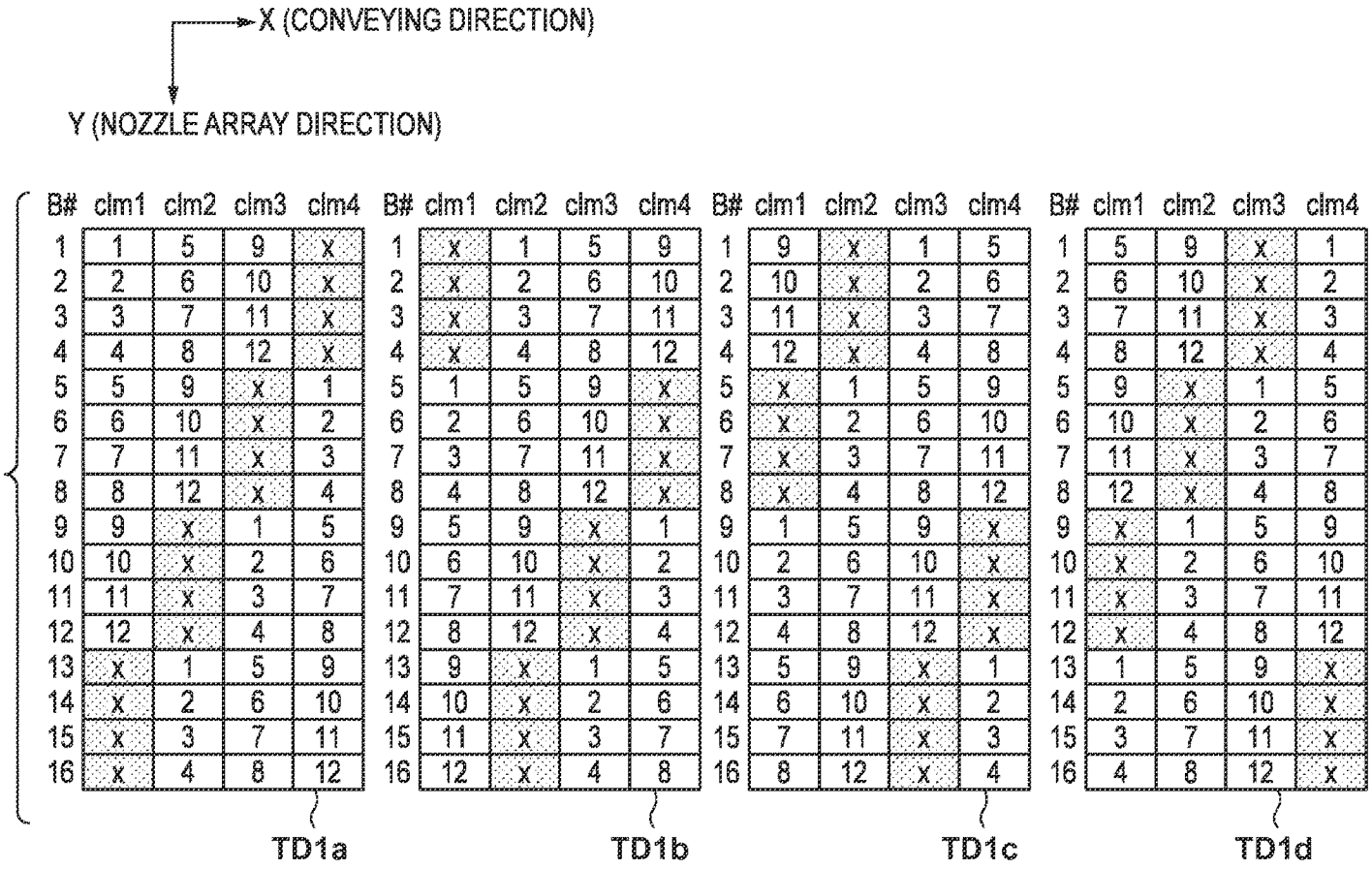

FIG. 7B shows the driving order of the driving nozzles selected based on each of the above restriction patterns. For example, the ROM 143 stores in advance a driving order reference table for defining the driving order (block driving order) of the nozzles nz of each group G. It is possible to set the driving order of the driving nozzles based on each restriction table with reference to the driving order reference table. For the sake of simplicity, a case in which the driving order of the driving nozzles complies with the order of the block numbers will be exemplified.

For example, in a driving order TD1*a* of the driving nozzles in the nozzle array La1, the nozzles are driven in the order of B#1, B#2, . . . , B#12 with respect to the column clm1, and thus the nozzle array La prints dots for the column clm1. The nozzles are driven in the order of B#13, B#14, B#15, B#16, B#1, B#2, . . . , B#8 with respect to the column clm2, and thus the nozzle array La prints dots for the column clm2.

The phases of the cycles of the block driving orders defined in the driving order reference table are shifted by 90° between the respective nozzle arrays L. Therefore, for example, in a driving order TD1*b* of the driving nozzles in the nozzle array Lb, the nozzles are driven in the order of B#5, B#6, . . . , B#16 with respect to the column clm1, and thus the nozzle array Lb prints dots for the column clm1. The nozzles are driven in the order of B#1, B#2, . . . , B#12 with respect to the column clm2, and thus the nozzle array Lb prints dots for the column clm2. Note that the same applies to a driving order TD1*c* of the driving nozzles in the nozzle array Lc, a driving order TD1*d* of the driving nozzles in the nozzle array Ld, and the remaining columns clm3 and clm4.

FIG. 7C shows a priority level reference table TP1 for defining the priority level or priority order of driving of each driving nozzle. The table TP1 is a reference table for specifying a driving nozzle to be preferentially driven when printing one or more dots in a corresponding column by two or more driving nozzles having the same block number. The table TP1 is referred to, based on the print data (four-level data of one of levels 0 to 3) which have been stored in advance in the ROM 143 and have undergone the quantization processing in S130, thereby determining a driving target from the selected driving nozzles.

For example, "cda" is defined for B#1 of the column clm1, which indicates that the nozzle array Lc has the highest priority, the nozzle array Ld has the second highest priority, and the nozzle array La has the lowest priority. For example, consider a case in which among the print data having undergone the quantization processing in S130, data corresponding to B#1 of the column clm1 is at level 1, that is, the number of dots to be printed is 1. In this case, one dot is printed at a print position corresponding to B#1 of the column clm1 by the nozzle nz of B#1 of the nozzle array Lc having the highest priority.

Furthermore, for example, "dac" is defined for B#2 of the column clm1, which indicates that the nozzle array Ld has the highest priority, the nozzle array La has the second highest priority, and the nozzle array Lc has the lowest priority. For example, consider a case in which among the print data having undergone the quantization processing in S130, data corresponding to B#2 of the column clm1 is at level 2, that is, the number of dots to be printed is 2. In this case, two dots are printed at a print position corresponding to B#2 of the column clm1 by the nozzle nz of B#2 of the nozzle array Ld having the highest priority and the nozzle nz of B#2 of the nozzle array La having the second highest priority.

Figure 8A:
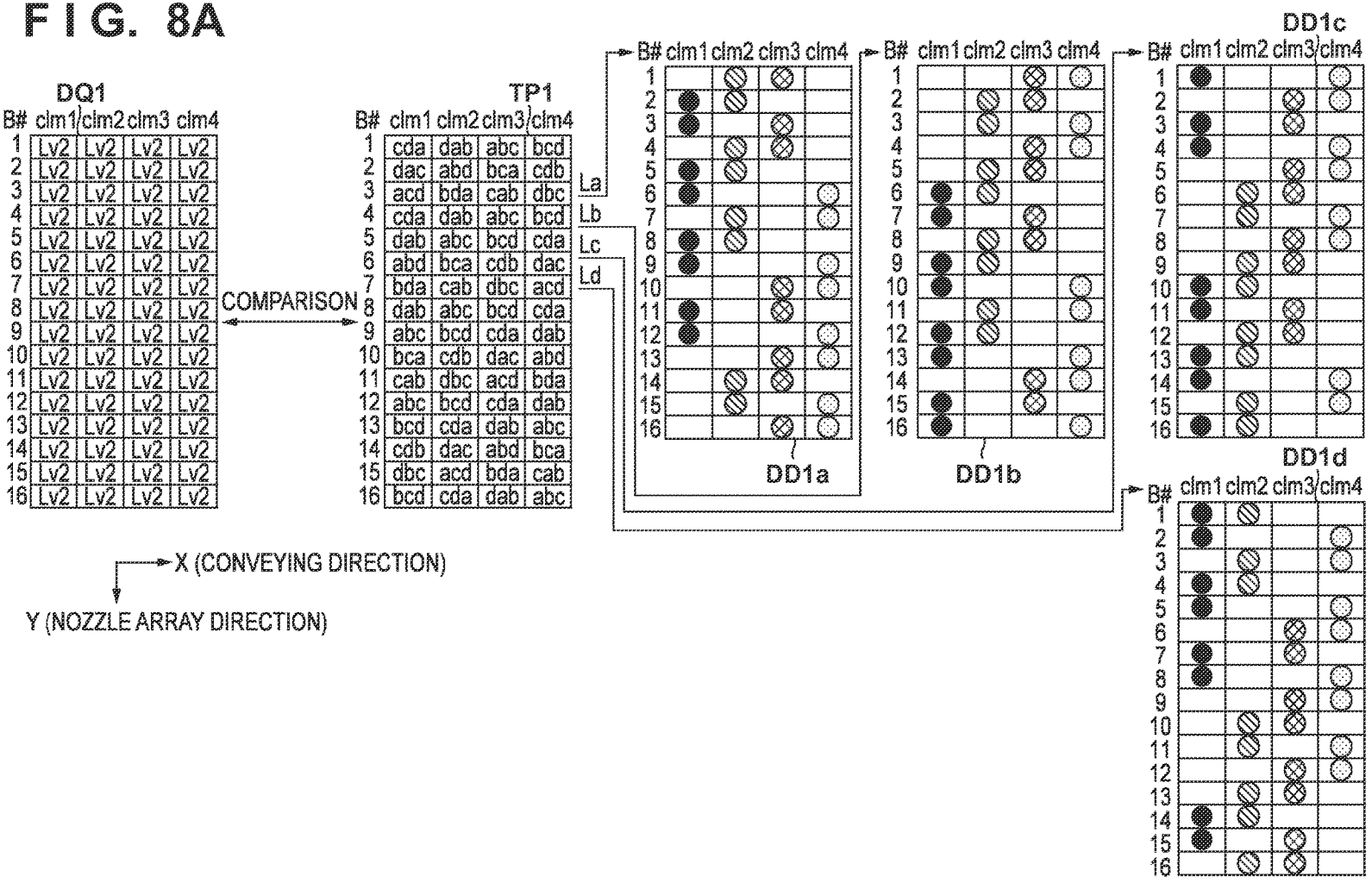
FIGS. 8A and 8B are views for explaining an example of the print data processing method and examples of dots formed on a printing medium.

FIG. 8A is a view for explaining an example of a method of distributing print data DQ1 having undergone the quantization processing in S130 to the respective nozzle arrays La to Ld. For the sake of simplicity, consider a case in which data corresponding to each column and each block in the print data DQ1 is at level 2.

Print data DD1*a* to DD1*d* respectively assigned to the nozzle arrays La to Ld are dot data each indicating whether to print dots, and are determined based on the print data DQ1 and the above-described priority level reference table TP1. More specifically, the specific nozzle array L whose driving nozzle is to be used to print a dot corresponding to data corresponding to each column and each block in the print data DQ1 is determined based on the priority level of driving of each driving nozzle.

In this example, since the priority levels of B#1 of the column clm1 are indicated by "cda", dot data (indicated by a solid circle in FIG. 8A) is assigned to a portion corresponding to B#1 of the column clm1 of each of the print data DD1*c* and DD1*d*. Thus, two dots are printed at the print position corresponding to B#1 of the column clm1 by the driving nozzles of B#1 of the nozzle arrays Lc and Ld.

Similarly, since the priority levels of B#2 of the column clm1 are indicated by "dac", dot data (indicated by a solid circle in FIG. 8A) is assigned to a portion corresponding to B#2 of the column clm1 of each of the print data DD1*d* and DD1*a*. Thus, two dots are printed at the print position corresponding to B#2 of the column clm1 by the driving nozzles of B#2 of the nozzle arrays Ld and La. The same applies to the remaining block numbers B#3 to B#16 and the remaining columns clm2 to clm4.

The thus determined print data DD1*a* to DD1*d* are distributed to the corresponding nozzle arrays La to Ld, respectively.

Figure 8B:
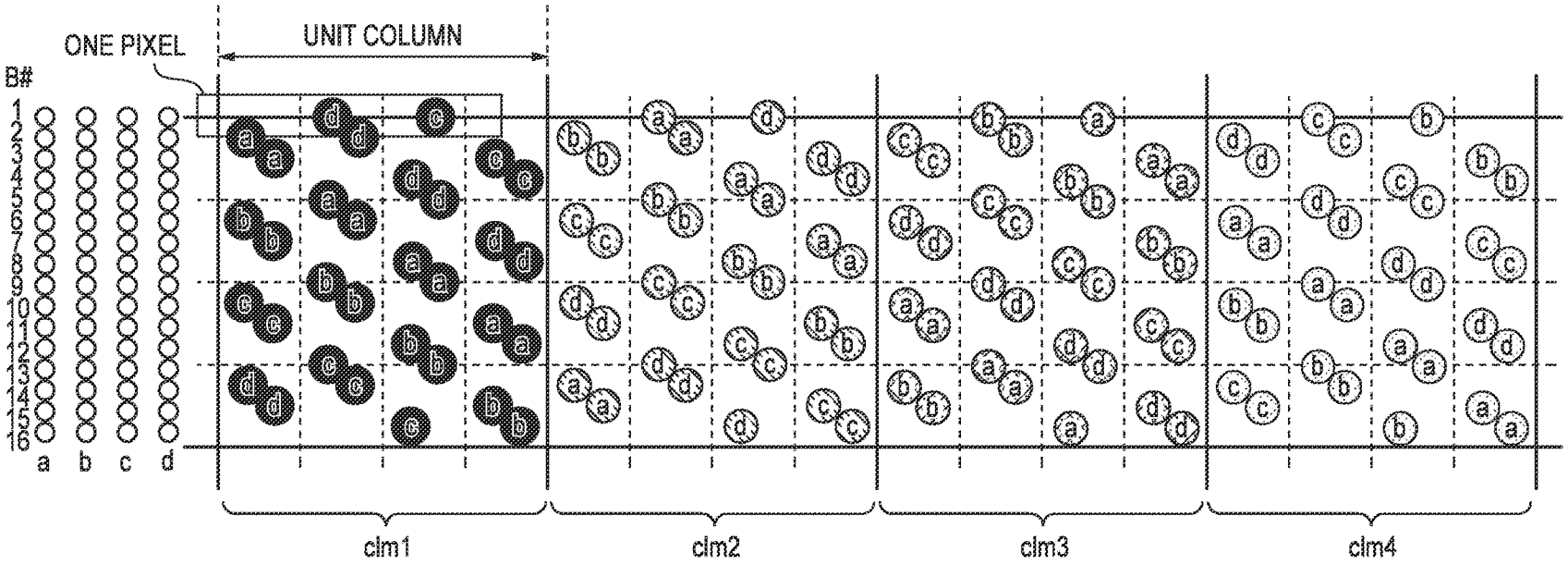

FIG. 8B is a view for explaining dots on the sheet P, which have been printed by the nozzle array La and the like based on the distributed print data DD1*a* and the like. The driving nozzles of the nozzle array La and the like are sequentially driven according to the driving order TD1*a* and the like described with reference to FIG. 7B, and print dots based on the distributed print data DD1*a* and the like. As described above, in each column corresponding to 1,200 dpi, a dot is printed by each nozzle nz selected as a driving nozzle in the column data corresponding to the column.

Note that for the sake of simplicity, a symbol is assigned to each dot in FIG. 8B so as to recognize one of the nozzle arrays La to Ld whose driving nozzle has printed the dot. For example, a dot with "a" is a dot printed by the driving nozzle of the nozzle array La. The same applies to "b" to "d".

For example, in the column clm1, the nozzles nz of B#13 to B#16 of the nozzle array La are non-driving nozzles. Dots corresponding to B#13 to B#16 are printed by the nozzles nz of B#13 to B#16 which are driving nozzles in the nozzle arrays Lb to Ld other than the nozzle array La. Similarly, in the column clm2, the nozzles nz of B#9 to B#12 of the nozzle array La are non-driving nozzles, and dots corresponding to B#9 to B#12 are printed by the nozzles nz of B#9 to B#12 which are driving nozzles in the remaining nozzle arrays Lb to Ld.

As for each column data, this driving method selects some of the plurality of nozzles nz of each nozzle array L as non-driving nozzles, and selects the remaining nozzles nz as driving nozzles. The non-driving nozzles are selected so the non-driving nozzles do not overlap each other between the nozzle arrays L in the conveying direction X of the sheet P. That is, a dot (a dot which is not printed by a non-driving nozzle) corresponding to a non-driving nozzle of a given nozzle array (for example, the nozzle array La) is printed by a driving nozzle of another nozzle array (for example, one of the nozzle arrays Lb to Ld), thereby completing printing of dots corresponding to the print data.

When the conveying speed of the sheet P is increased to improve the throughput, if all the plurality of nozzles nz of each nozzle array L are driven, the print positions of some dots fall outside the corresponding columns. To print these dots in the corresponding columns, for example, it is necessary to increase the operation speed of each nozzle array L, for example, the driving frequency of each nozzle array L, leading to an increase in manufacturing cost by, for example, changing the design of hardware.

To solve this problem, according to this driving method, some of the plurality of nozzles nz are selected as non-driving nozzles and their driving is limited, and dots corresponding to the non-driving nozzles are printed by driving nozzles of another nozzle array different from a nozzle array to which the non-driving nozzles belong. Consequently, this driving method can appropriately print all dots in the corresponding columns without changing the operation speed of each nozzle array L, and is advantageous in improving the throughput of the printing apparatus while suppressing the manufacturing cost. The driving nozzles and non-driving nozzles are shifted for each column data (in other words, the nozzles nz which serve as non-driving nozzles for given column data are driven as driving nozzles for the next column data), thereby effectively using all the plurality of nozzles nz.

2-2. Print Position Shift

In the arrangement in which while conveying a longitudinally long-shaped printing medium such as the sheet P, printing is executed on the sheet P, the frictional force between the conveying roller 130 and the sheet P may change due to a change in environment such as heat and humidity, thereby changing the conveying speed of the sheet P. This causes a print position shift of a dot between the nozzle arrays L of the printhead 110, and such print position shift may degrade the image quality. A method will be exemplified below in which the printing timings of some nozzle arrays L are delayed by inserting null data (data indicating that no dots are printed) to the print data in accordance with a change in conveying speed, and synchronized with the printing timings of the remaining nozzle arrays.

Null data is inserted based on an analysis result obtained by reading and analyzing a predetermined adjusting pattern printed or formed on the sheet P. The adjusting pattern is read by, for example, the above-described scanner 200. The adjusting pattern is analyzed by, for example, the CPU 141 of the control unit 140 described above, a dedicated arithmetic processing unit (not shown), or the like. More specifically, a shift amount of the landing position of an ink droplet when the adjusting pattern is printed is analyzed, and a printing timing shift amount between the nozzle arrays L when the adjusting pattern is printed is acquired. After that, null data corresponding to the printing timing shift amount is generated, and inserted to the print data assigned to the corresponding nozzle array. This corrects the print position shift between the nozzle arrays L.

As described above, it is possible to maintain the image quality by analyzing an adjusting pattern printed for each predetermined region in the conveying direction of the sheet P, and correcting a print position shift in accordance with the analysis result.

Figure 9A:
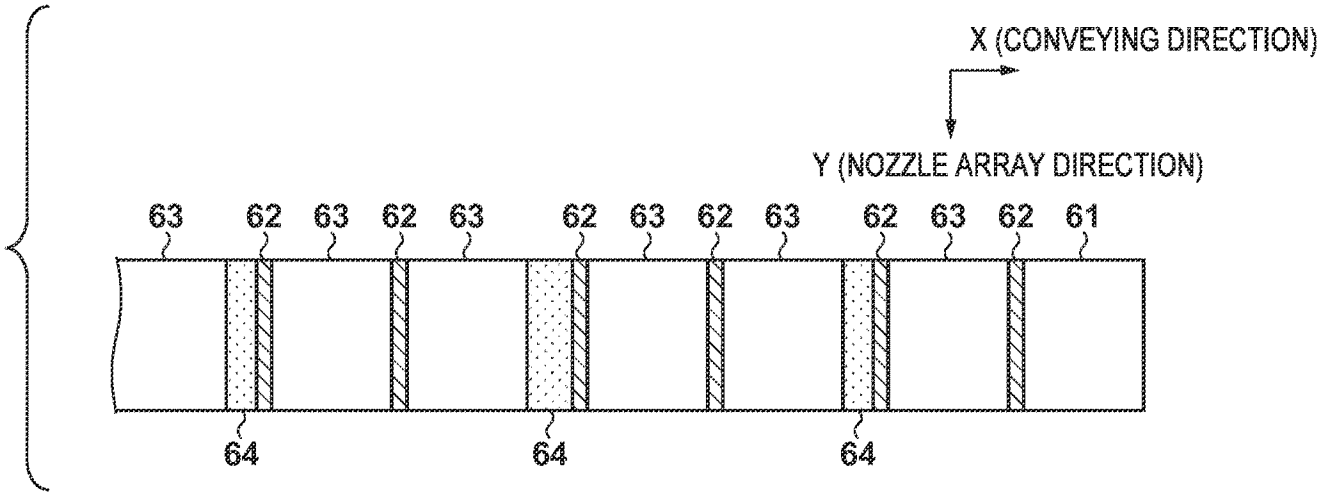
FIGS. 9A to 9C are views for explaining an example of an adjusting pattern.
Figure 9B:
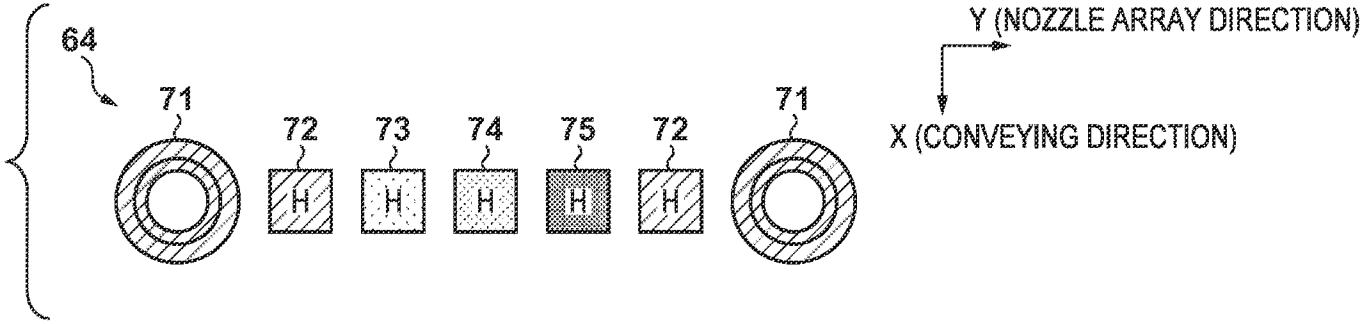
Figure 9C:
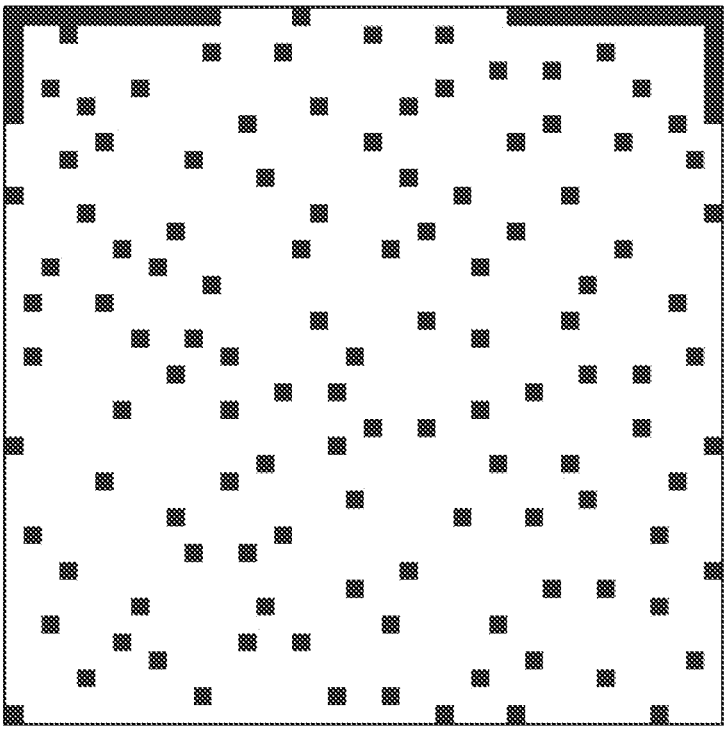

FIGS. 9A to 9C are views for explaining an example of an adjusting pattern. As exemplified in FIG. 9A, a start pattern 61, a cut pattern 62, an image 63, and an adjusting pattern 64 are sequentially printed on the sheet P from the downstream side of the conveying direction. For example, before the start of printing based on the print data, the start pattern 61 can be printed by each nozzle nz of each nozzle array L to recover the discharge performance of the nozzle nz. The cut pattern 62 is a pattern printed between unit images, and includes, for example, a mark for cutting the sheet P per page unit. The cut pattern 62 may further include a pattern for preliminary discharge to recover the discharge performance of each nozzle nz. The image 63 indicates a unit image, and images corresponding to the print data are printed on the sheet P.

The adjusting pattern 64 is printed in a non-image printing portion between the two images 63 printed on the sheet P, and read by the scanner 200. Although FIG. 9A exemplifies a case in which the adjusting pattern 64 is printed after the cut pattern 62 is printed after the two images 63 are printed, the present invention is not limited to this. For example, the adjusting pattern 64 may be printed before the cut pattern 62 is printed. The adjusting pattern 64 need only be printed every time the image 63 of a predetermined length or more in the conveying direction is printed. The adjusting pattern 64 is printed at a given interval or a different predetermined interval. For example, the adjusting pattern 64 may be printed every time one image 63 is printed or every time three or more images 63 are printed. That is, the length of the image 63 or the number of images 63 to be printed for one adjusting pattern 64 is determined based on, for example, the accuracy of the printhead 110, the time taken to analyze the adjusting pattern 64, and the like.

FIG. 9B shows a practical example of the adjusting pattern 64. The adjusting pattern 64 includes, for example, detection marks 71 for detecting the adjusting pattern 64 by the scanner 200, and matching patterns 72 to 75 for respective ink colors. For example, the pattern 72 corresponds to black (K), the pattern 73 corresponds to cyan (C), the pattern 74 corresponds to magenta (M), and the pattern 75 corresponds to yellow (Y).

FIG. 9C shows practical examples of the matching patterns 72 to 75. The patterns 72 to 75 need only have the same shape, and may have a random shape such as a dot pattern shown in FIG. 9C. The patterns 72 to 75 are read by the scanner 200, and then matched, thereby calculating a print position shift amount (relative value) for each color. Although a print position shift for each color has been explained, the same applies to a print position shift between the nozzle arrays La to Ld of the same color.

Note that the patterns 72 to 75 need only be matched by a method exemplified in Japanese Patent Laid-Open No. 2010-105203 or another known method. In this example, the print position shift amount is a relative value between nozzle arrays. However, with reference to a nozzle array on the most downstream side of the conveying direction among the four nozzle arrays corresponding to a given nozzle substrate (for example, black (K)), the print position shift of each of the remaining nozzle arrays may be corrected.

2-3. Example of Print Position Shift Correction Method

Figure 10:
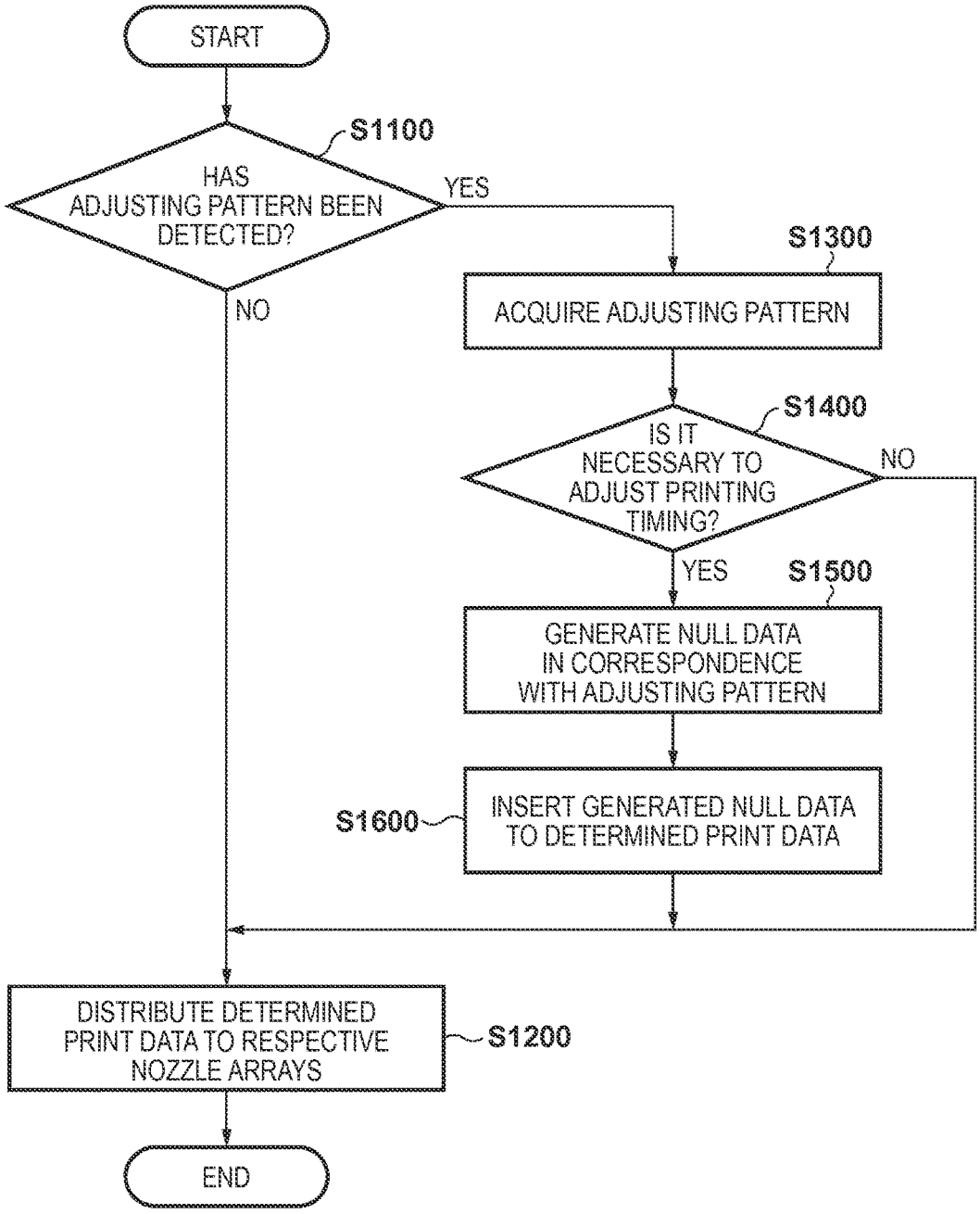
FIG. 10 is a flowchart for explaining an example of a print position shift correction method.

FIG. 10 is a flowchart for explaining an example of a print position shift correction method. The flowchart corresponds to S144 described with reference to FIG. 6.

In S1100, it is determined whether the adjusting pattern 64 has been detected. If no adjusting pattern 64 has been detected, the process advances to S1200, that is, the print data determined in S143 of FIG. 6 described above are distributed to the respective nozzle arrays L. On the other hand, if the adjusting pattern 64 has been detected, the process advances to S1300. In S1300, the adjusting pattern 64 is read and analyzed, and the process advances to S1400.

In S1400, a printing timing shift amount between the nozzle arrays L is acquired based on the analysis result and it is determined whether it is necessary to adjust the printing timing. This step may be performed by comparing the magnitude of the printing timing shift amount with that of a predetermined value (predetermined threshold). If it is not necessary to adjust the printing timing, the process advances to S1200, that is, the print data determined in S143 are distributed to the respective nozzle arrays L. On the other hand, if it is necessary to adjust the printing timing, the process advances to S1500.

In S1500, null data for adjusting the printing timing is generated, and the process advances to S1600. Null data need only be generated based on the printing timing shift amount and a detailed description thereof will be provided later. In S1600, the null data generated in S1500 is inserted to the print data determined in S143, and the process advances to S1200. In this case, in S1200, the print data to which the null data has been inserted are distributed to the respective nozzle arrays L.

Figure 11:
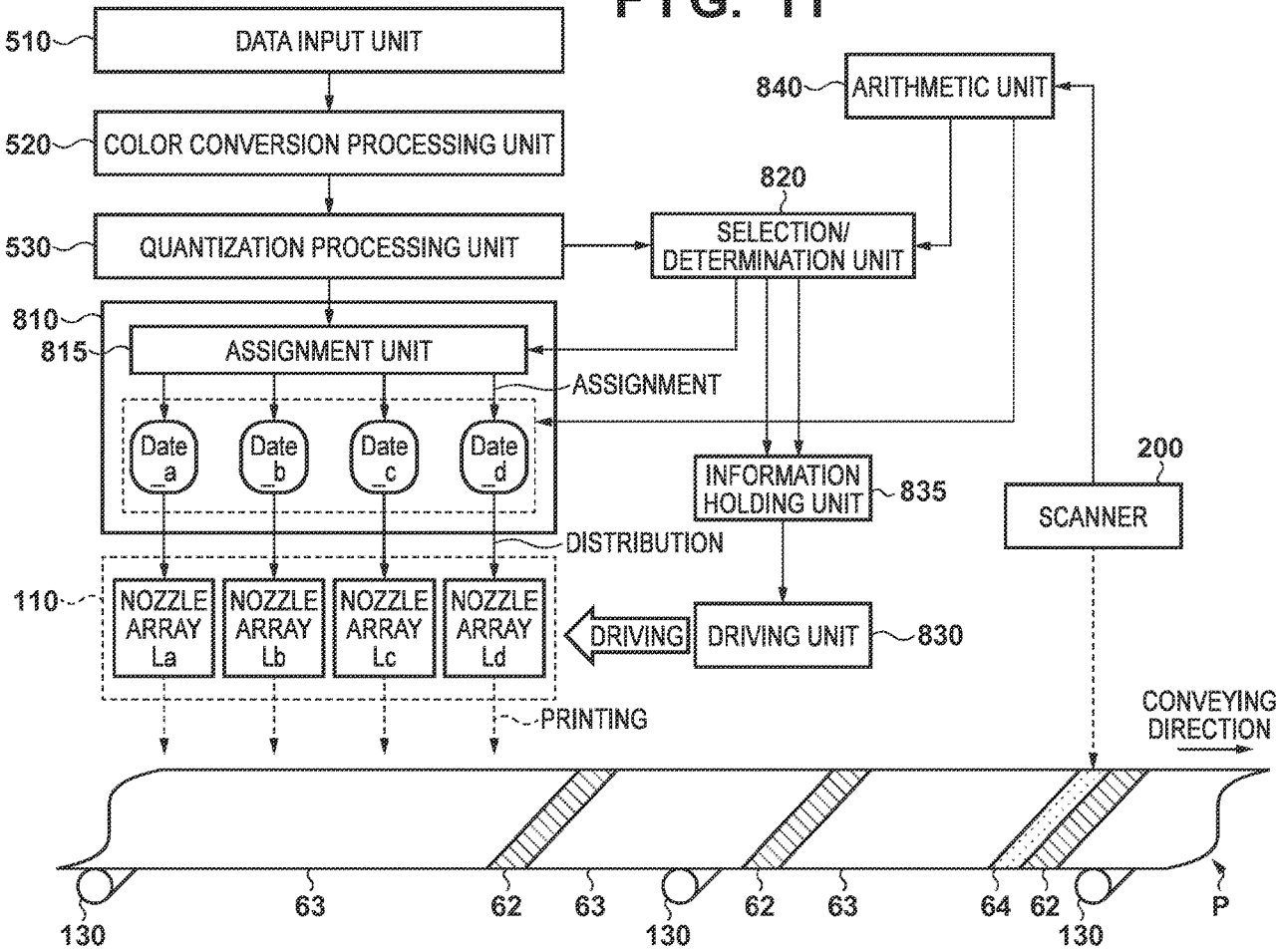
FIG. 11 is a block diagram for explaining the example of the print position shift correction method.

FIG. 11 is a block diagram for explaining a data flow corresponding to the aforementioned flowchart. As described with reference to FIG. 5B, the print data input from the data input unit 510 undergo the color conversion processing by the color conversion processing unit 520, undergo the quantization processing by the quantization processing unit 530, and are then converted into four-level data (levels 0 to 3). A selection/determination unit 820 selects driving nozzles and non-driving nozzles according to the same procedure as that described above, receives the converted print data (indicated by A1 in FIG. 11), and determines driving nozzles to be driven.

An assignment unit 815 of a distribution processing unit 810 assigns the converted print data to the respective nozzle arrays L based on the result of selection or determination by the selection/determination unit 820 (indicated by A2 in FIG. 11). Print data Data_a and the like shown in FIG. 11 correspond to the print data assigned to the nozzle array La and the like. The distribution processing unit 810 distributes the assigned print data Data_a and the like to the corresponding nozzle arrays L of the printhead 110. The selection/determination unit 820 stores, in an information holding unit 835, information for specifying the driving nozzles and non-driving nozzles which have been selected for each column data (indicated by A3 in FIG. 11). Based on the distributed print data, a driving unit 830 drives the driving nozzles of each nozzle array L with reference to the information held in the information holding unit 835. This prints the image 63 on the sheet P.

When the adjusting pattern 64 printed on the sheet P is detected, the scanner 200 reads the adjusting pattern 64. An arithmetic unit 840 acquires a printing timing shift amount between the nozzle arrays L based on the read adjusting pattern 64, and determines whether it is necessary to adjust the printing timing. If it is determined that it is necessary to adjust the printing timing, the selection/determination unit 820 receives the result of the shift amount (indicated by B1 in FIG. 11), and outputs information based on the shift amount to the information holding unit 835 (indicated by B2 in FIG. 11). To correct the print position shift, the arithmetic unit 840 inserts null data corresponding to the shift amount to the correction target print data among the assigned print data Data_a and the like (indicated by B3 in FIG. 11).

With this arrangement, it is possible to analyze the adjusting pattern printed for each predetermined region in the conveying direction of the sheet P, and correct the print position shift between the nozzle arrays L for each analysis operation. Note that this arrangement is merely an exemplary arrangement for executing an example of the above-described flowchart, and the control unit 140 may include dedicated arithmetic processing units corresponding to the above-described unit 520 and the like or the CPU 141 may have functions corresponding to the unit 520 and the like.

A practical example of the above flowchart will be described with reference to FIGS. 12A, 12B, 13A to 13E, and 14. Note that a description will be provided by paying attention to the nozzle array La for the sake of simplicity. However, the same applies to the remaining nozzle arrays Lb to Ld of the same color and the nozzle arrays L of different colors.

Figure 12A:
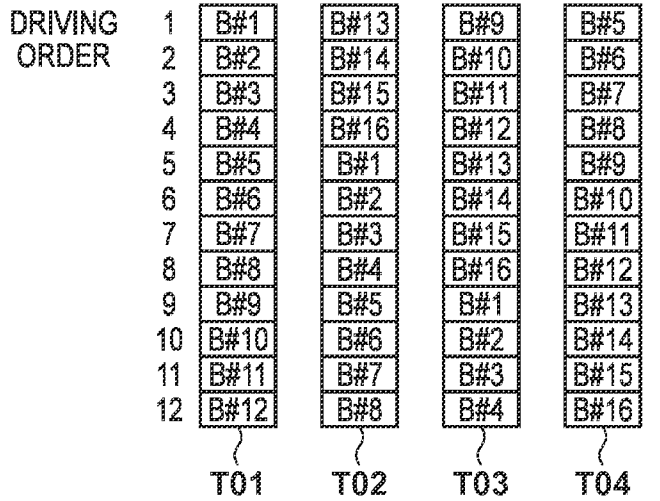
FIGS. 12A and 12B are views for explaining a selection number for specifying driving nozzles and non-driving nozzles.

FIG. 12A shows the driving order of the driving nozzles selected for each column data. A flag number F# shown in FIG. 12A is a selection number for specifying the driving nozzles and non-driving nozzles selected for each column data, and held in the above-described information holding unit 835. A flag F#1 indicates that the nozzles nz of B#1, B#2, . . . , B#12 are sequentially driven, and the remaining nozzles nz as non-driving nozzles are not shown. A flag F#2 indicates that the nozzles nz of B#13, B#14, B#15, B#16, B#1, . . . , B#8 are sequentially driven, and the remaining nozzles nz as non-driving nozzles are not shown. The same applies to flags F#3 and F#4.

Figure 12B:
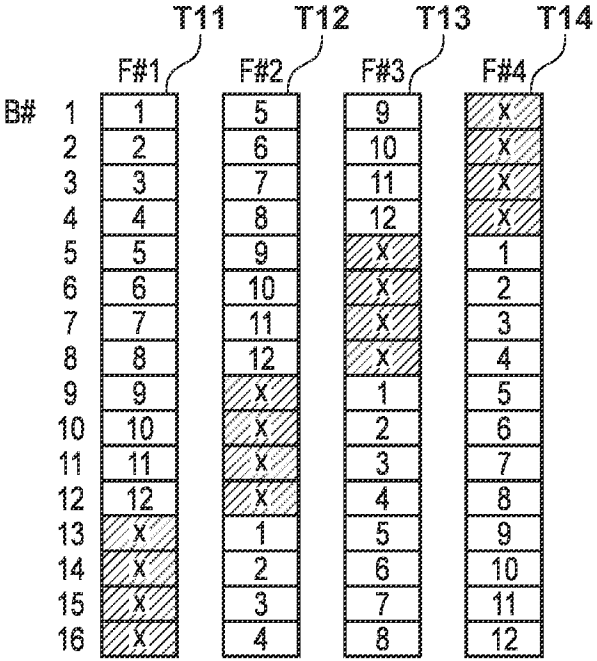

FIG. 12B shows the driving nozzles and non-driving nozzles corresponding to each of the flags F#1 to F#4 in which portions corresponding to the driving nozzles are assigned with numbers indicating the driving order, and portions corresponding to the non-driving nozzles are assigned with "x".

Figure 13A:
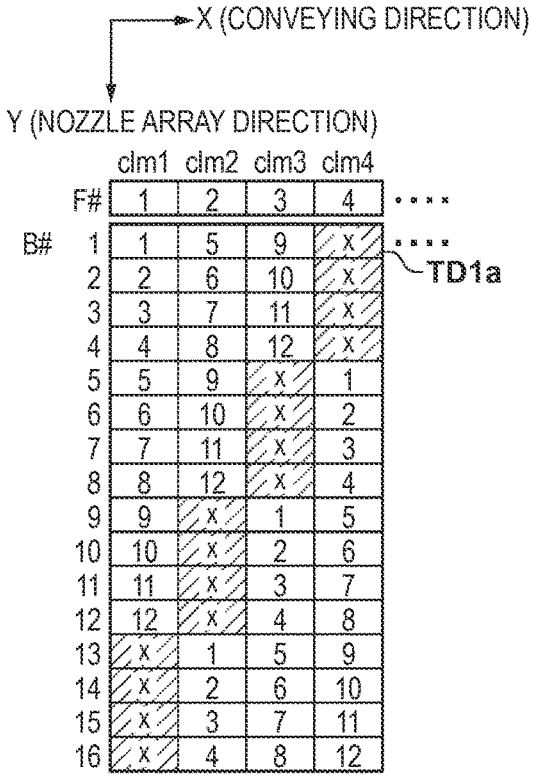
FIGS. 13A to 13E are views for explaining an example of print data to which null data has been inserted.

FIG. 13A shows the relationship between the driving order TD1*a* (the driving order of the driving nozzles in the nozzle array La) exemplified in FIG. 7B described above and the flag number, that is, F#1 to F#4 corresponding to each column. The flag F#1 is assigned to the column clm1. Similarly, the flags F#2 to F#4 are respectively assigned to other columns clm2 to clm4.

In this example, since four of the 16 nozzles nz of B#1 to B#16 are sequentially selected as non-driving nozzles for each column data, a selection interval corresponds to column data for four columns. Therefore, the flag F#1 is assigned to a fifth column clm5 (not shown), and similarly, the flags F#2 to F#4 are respectively assigned to sixth to eighth columns clm6 to clm8. The same applies to the subsequent columns. For example, the flag number held in the information holding unit 835 is shifted (one is added) every time printing corresponding to column data for one column is completed, and when the flag number is larger than four, a remainder obtained by dividing the number by four is set as a new flag number. The above-described driving unit 830 can drive the driving nozzles among the driving nozzles and non-driving nozzles with reference to the flag number held in the information holding unit 835.

Figure 13B:
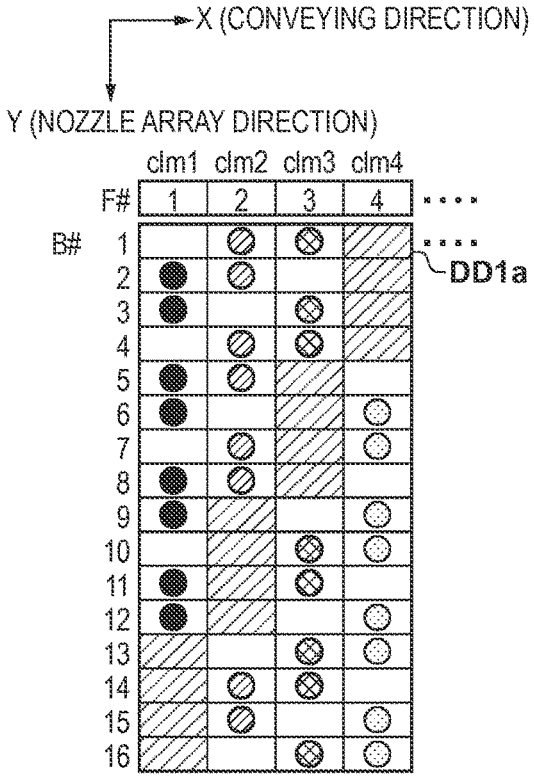

FIG. 13B shows the relationship between the print data DD1*a* (the print data assigned to the nozzle array La among the print data) exemplified in FIG. 8A described above and the flag number, that is, F#1 to F#4 corresponding to each column. In this example, in the column clm1, the driving nozzles of B#2, B#3, B#5, B#6, B#8, B#9, B#11, and B#12 are sequentially driven. Similarly, in the column clm2, the driving nozzles of B#14, B#15, B#1, B#2, B#4, B#5, B#7, and B#8 are sequentially driven.

Figure 13C:
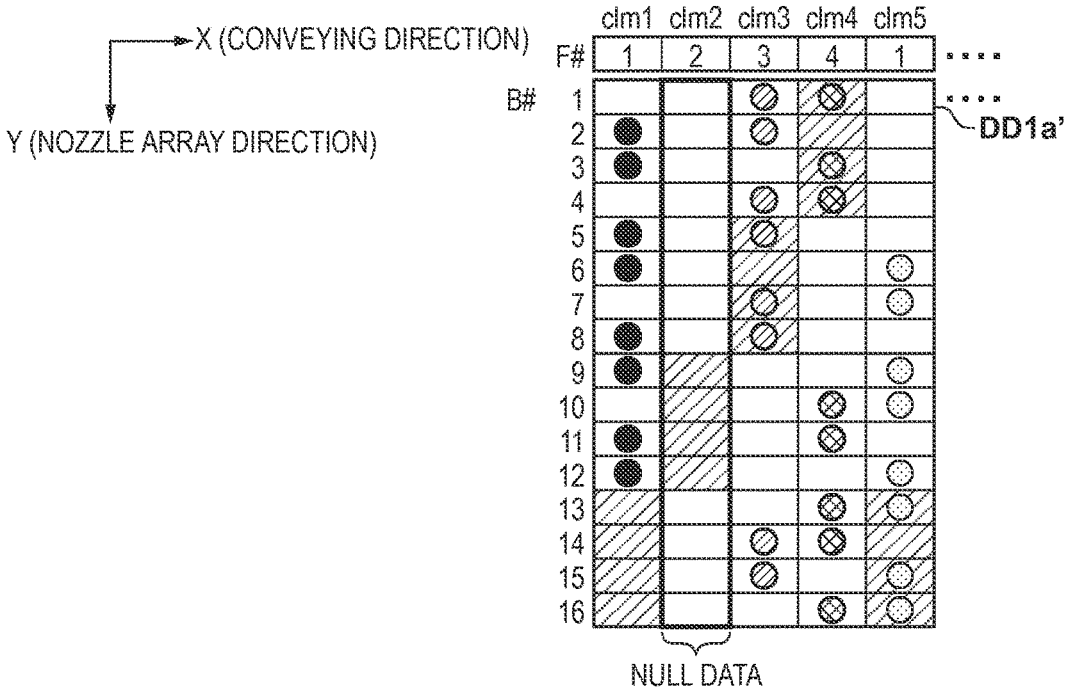

FIG. 13C exemplifies print data DD1*a*' obtained by inserting, between the columns clm1 and clm2, the column data (for one column) of null data for correcting the aforementioned print position shift with respect to the print data DD1*a*. The column data of the column clm2 and the subsequent columns are shifted by one column by the inserted null data. More specifically, the column data of the column clm2 and the subsequent columns are respectively shifted to the positions of the column clm3 and the subsequent columns.

When paying attention to the column clm3, the flag F#3 is assigned to the column clm3, that is, the nozzles nz of B#1 to B#4 and B#9 to B#16 are driving nozzles and the nozzles nz of B#5 to B#8 are non-driving nozzles. On the other hand, since the column data assigned to the column clm2 is shifted to the position of the column clm3 by inserting the null data, some dots corresponding to B#5, B#7, and B#8 are not printed. Similarly, with respect to the column clm4, some dots corresponding to B#1, B#3, and B#4 are not printed. With respect to the column clm5, some dots corresponding to B#13, B#15, and B#16 are not printed. That is, when the null data is inserted, it is necessary to newly select driving nozzles and non-driving nozzles accordingly.

Figure 13D:
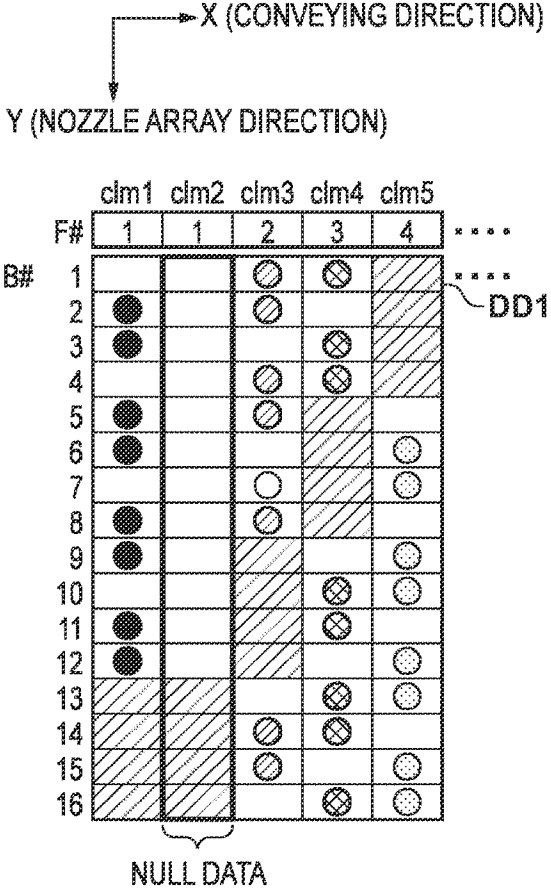

FIG. 13D exemplifies the relationship between the print data DD1*a*' to which the null data has been inserted and the corresponding flag number. In this example, the flag numbers of the column clm2, to which the null data has been inserted, and the subsequent columns are different from those in FIG. 13C. More specifically, the flag F#1 is assigned to the column 2 by changing the flag number, and similarly, the flags F#2 to F#4 are assigned to the columns clm3 to clm5. By comparing FIGS. 13B and 13D, the flag number can be considered to be held for a period corresponding to the column data for one column in response to insertion of the null data. Consequently, all the dots are printed by the corresponding driving nozzles, thereby appropriately executing printing in accordance with the print data DD1*a*' to which the null data has been inserted.

Figure 13E:
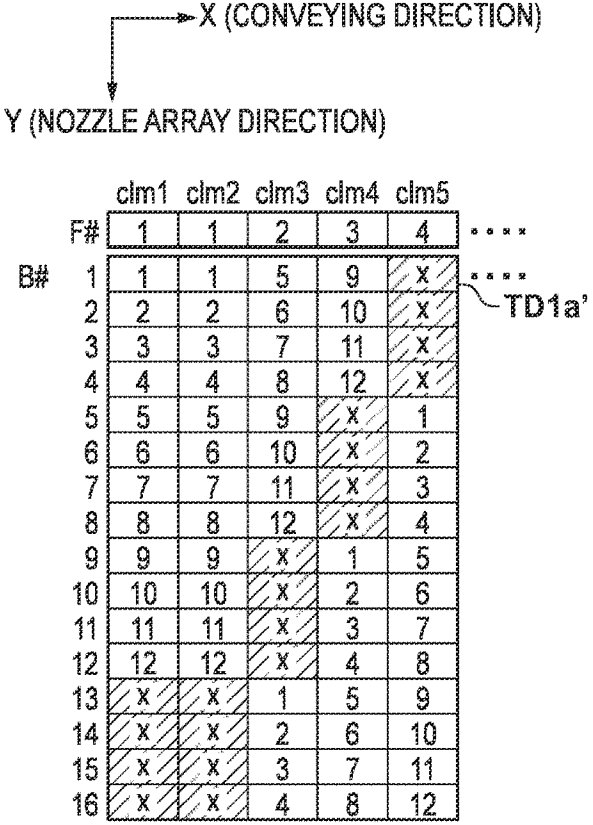

FIG. 13E shows the relationship between a driving order TD1*a*' corresponding to the print data DD1*a*' and the corresponding flag number, similarly to FIG. 13A. By comparing FIGS. 13A and 13E, the driving timing of the corresponding nozzle array L can be considered to be held for the period corresponding to the column data for one column in response to insertion of the null data.

Note that a case in which the null data is inserted to the column clm2 has been explained for the sake of simplicity but the timing at which the print position shift is actually corrected (that is, the timing at which the null data is inserted) is not limited to this. That is, the print position shift may be corrected when a print job of a predetermined unit is complete. For example, the print position shift is corrected after analysis of the adjusting pattern is completed (after the null data to be inserted is generated) and before printing of a unit image starts. More specifically, if analysis of the adjusting pattern is completed while the ith image is printed where i is an integer of 1 or more, the print position shift can be corrected after printing of the ith image is completed and before printing of the (i+1)th image starts.

Figure 14:
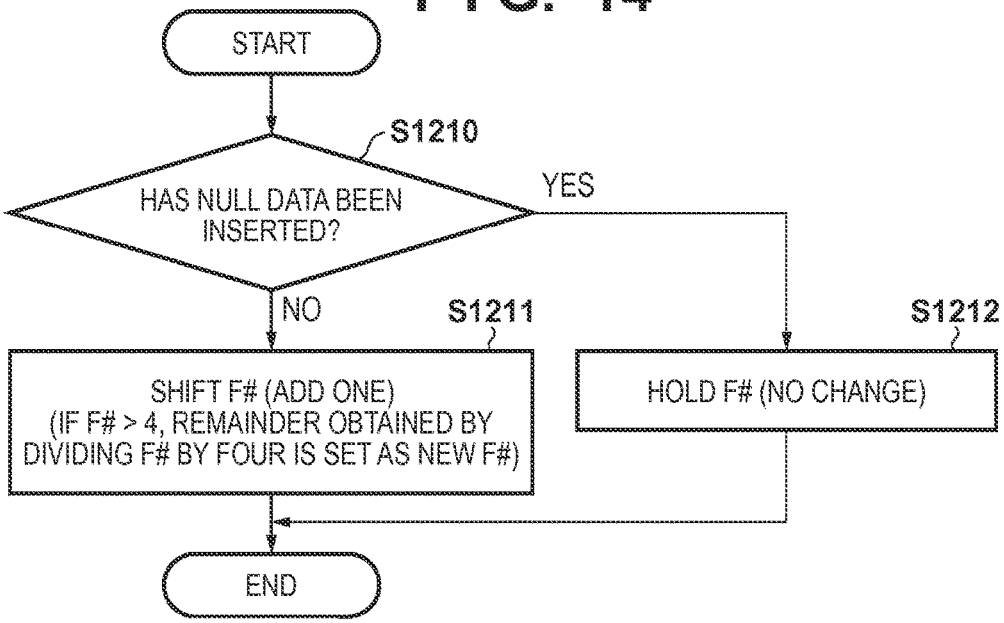
FIG. 14 is a flowchart for explaining an example of a method of shifting or holding the selection number.

FIG. 14 is a flowchart for explaining an example of a method of shifting or holding the flag number. This flowchart corresponds to S1200 described with reference to FIG. 10. In S1210, it is determined whether the null data has been inserted. If no null data has been inserted, the process advances to S1211; otherwise, the process advances to S1212.

If no null data has been inserted, the initially selected driving nozzles and non-driving nozzles may remain unchanged, and the flag number is shifted (one is added). In S1211, one is added to the flag number. In this example, the flags F#1 to F#4 are sequentially assigned for the respective column data. Therefore, if the flag number is larger than four as a result of adding one to the flag number, a remainder obtained by dividing the number by four is set as a new flag number. On the other hand, if the null data has been inserted, the process advances to S1212 to hold the flag number.

After that, the driving unit 830 drives each nozzle array L based on the flag number corresponding to S1211 or S1212. In this method, if the null data has been inserted, it is possible to appropriately print dots corresponding to each shifted column data by the initially selected driving nozzles.

Note that if data processing of, for example, preparing again the print data before assignment to each nozzle array and inserting the null data is performed to correct the print position shift, the load of the CPU 141 increases, for example, the memory use amount increases. To solve this problem, this correction method can determine print data to be assigned to the respective nozzle arrays L at the start of printing, and insert, to the determined print data, the null data for correcting the print position shift while executing printing. Consequently, this correction method suppresses the memory use amount, and is advantageous in reducing the load of the CPU 141.

Although a case in which the null data for one column is inserted has been exemplified, the number of null data corresponding to the shift amount need only be inserted, and when the print position shift amount is relatively large, null data for two or more columns may be inserted. Furthermore, although a case in which the flag number is used has been exemplified, the present invention is not limited to this, and it is only necessary to appropriately select new driving nozzles in response to insertion of null data.

2-4. Summary of Embodiment

According to this embodiment, some of the plurality of nozzles nz are selected as non-driving nozzles and their driving is limited, and thus dots corresponding to the non-driving nozzles are printed by driving nozzles of another nozzle array different from that to which the non-driving nozzles belong. Note that driving nozzles and non-driving nozzles are selected in advance when, for example, performing distribution processing of print data. In this method, even if the conveying speed of the sheet P is increased, it is possible to appropriately print all dots in corresponding columns without changing the operation speed of each nozzle array L. Therefore, this method is advantageous in improving the throughput of the printing apparatus while suppressing the manufacturing cost.

When the conveying speed of the sheet P is changed, this causes a print position shift between the nozzle arrays. Thus, while executing printing, the print position shift is corrected in accordance with a result of analyzing the adjusting pattern printed for each predetermined region in the conveying direction of the sheet P. The print position shift is corrected by inserting null data corresponding to the print position shift amount to the correction target print data among the print data assigned to the respective nozzle arrays. At this time, print data after the insertion portion of the correction target print data is shifted by inserting the null data, and thus driving nozzles and non-driving nozzles are newly selected so as to appropriately execute printing in accordance with the print data. This is done by using a predetermined parameter such as the above-described flag number for selecting or specifying the driving nozzles and non-driving nozzles selected for each column data. In this method, dots corresponding to the print data to which the null data has been inserted are printed by the initially selected driving nozzles.

This embodiment is advantageous in correcting a print position shift while improving the throughput of the printing apparatus by increasing the conveying speed of the printing medium.

2-5. Others

Although the printhead 110 including the four nozzle arrays La to Ld has been exemplified in this embodiment, the number of nozzle arrays is not limited to this and need only be two or more. For example, when the printhead 110 includes L nozzle arrays and each group G includes M nozzles nz where L represents an integer of 2 or more and M represents an integer of 2 or more and an multiple of L, M/L nozzles nz may be selected as non-driving nozzles. Note that the arrangement in which the nozzle array La and the like print dots of the same color has been exemplified. However, this embodiment is not limited to this as long as each nozzle can print a dot of an arbitrary color.

Although the arrangement of the full-line printhead 110 has been exemplified in this embodiment, the present invention may be applied to the arrangement of a serial printhead for performing printing by alternately repeating scanning of the printhead and conveyance of the printing medium.

3. Second Embodiment

The second embodiment will be described with reference to FIGS. 15 and 16A to 16D. In the above-described first embodiment, a case has been exemplified in which the flag number for specifying the driving nozzles and non-driving nozzles selected for each column data is shifted if no null data has been inserted, and is held if the null data has been inserted. The present invention, however, is not limited to this, and the flag number may be shifted or held by another method.

Figure 15:
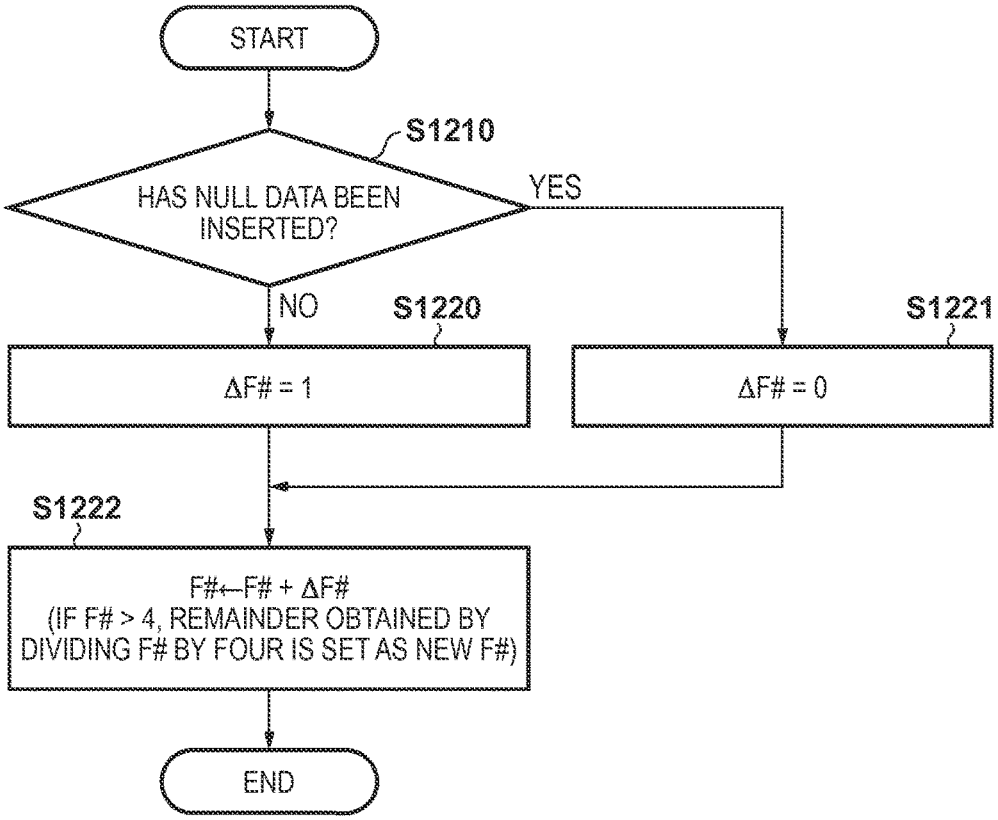
FIG. 15 is a flowchart for explaining an example of a method of shifting or holding a selection number.

FIG. 15 shows a flowchart for explaining another example of a method of shifting or holding a flag number, similarly to FIG. 14 in the first embodiment. In S1210, it is determined whether null data has been inserted. If no null data has been inserted, the process advances to S1220; otherwise, the process advances to S1221.

In S1220, a difference number ΔF# as a parameter for specifying whether to shift or hold the flag number is set to 1 (ΔF#1), and the process advances to S1222. On the other hand, in S1221, the difference number is set to 0 (ΔF#0), and the process advances to S1222.

In S1222, the difference number ΔF# is added to a flag number F#. More specifically, if no null data has been inserted (ΔF#1), the flag number is shifted (one is added). Note that the flag F#1 to F#4 are sequentially assigned to respective column data, similarly to the first embodiment. Thus, when the flag number is larger than four, a remainder obtained by dividing the number by four is set as a new flag number. On the other hand, if the null data has been inserted (ΔF#0), the flag number is held.

Figure 16A:
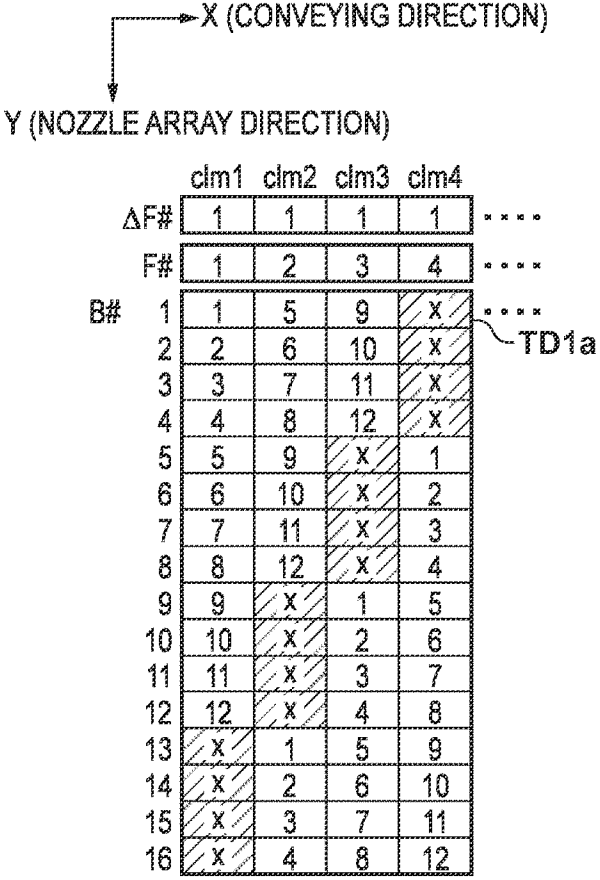
FIGS. 16A to 16D are views for explaining an example of print data to which null data has been inserted.
Figure 16B:
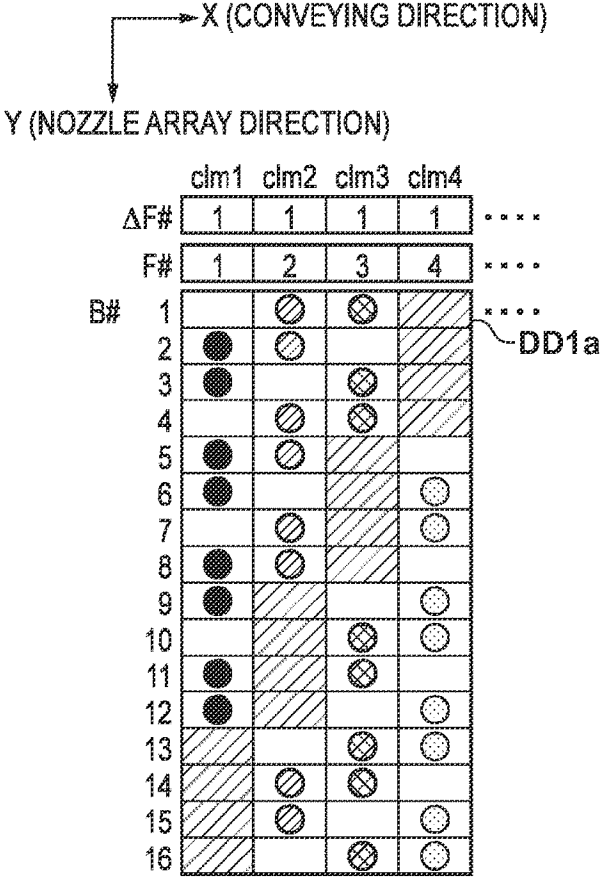
Figure 16C:
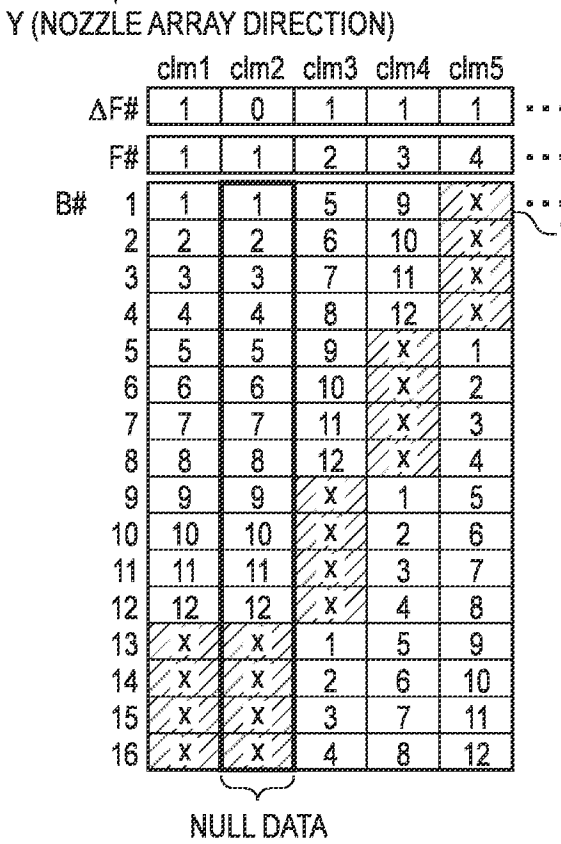
Figure 16D:
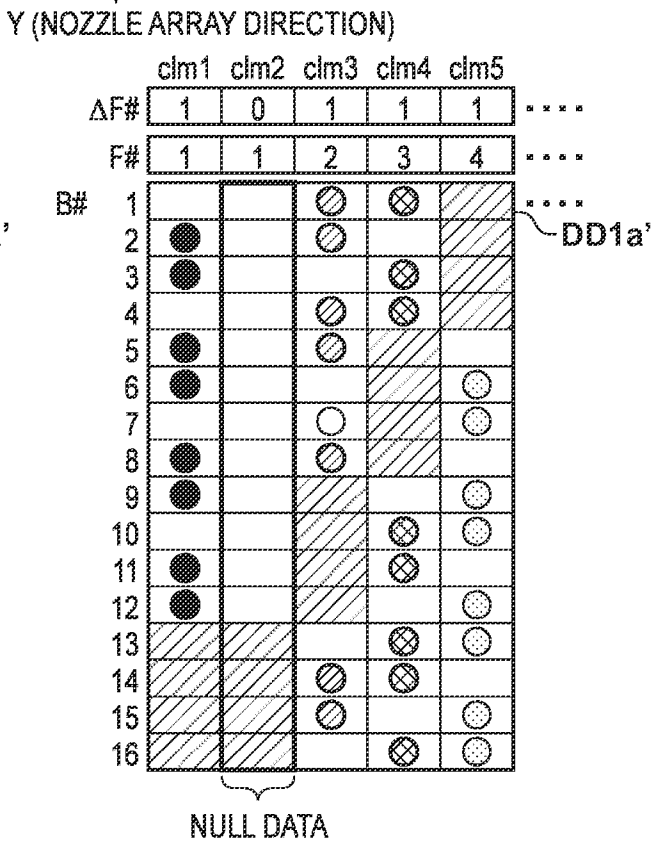
Figure 17A:
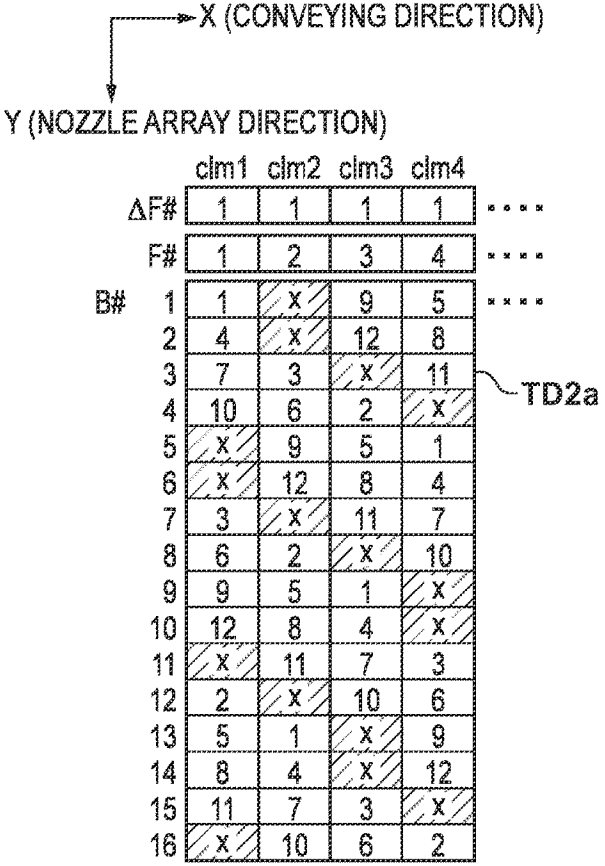
FIGS. 17A to 17D are views for explaining an example of print data to which null data has been inserted.
Figure 17B:
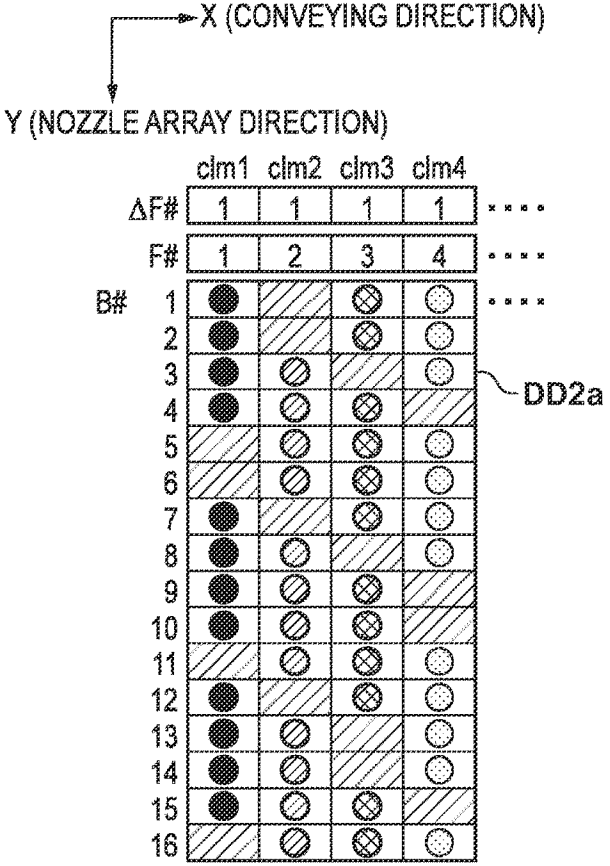
Figure 17C:
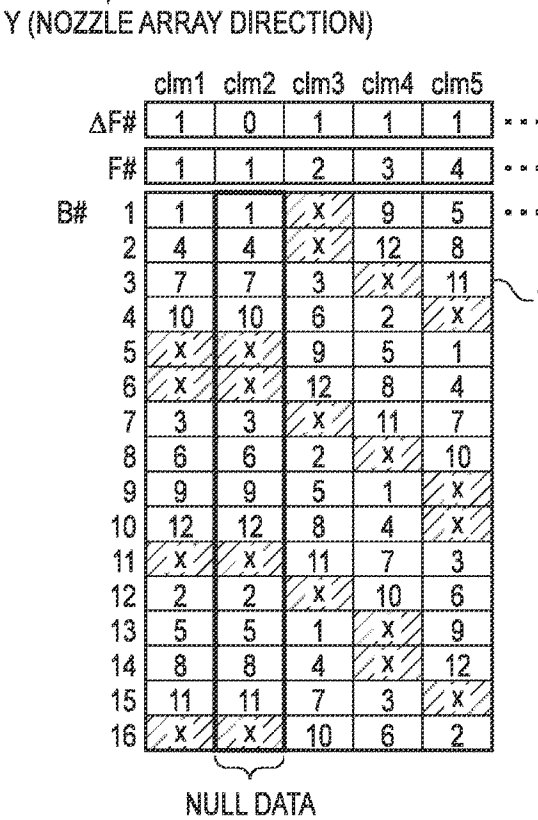
Figure 17D:
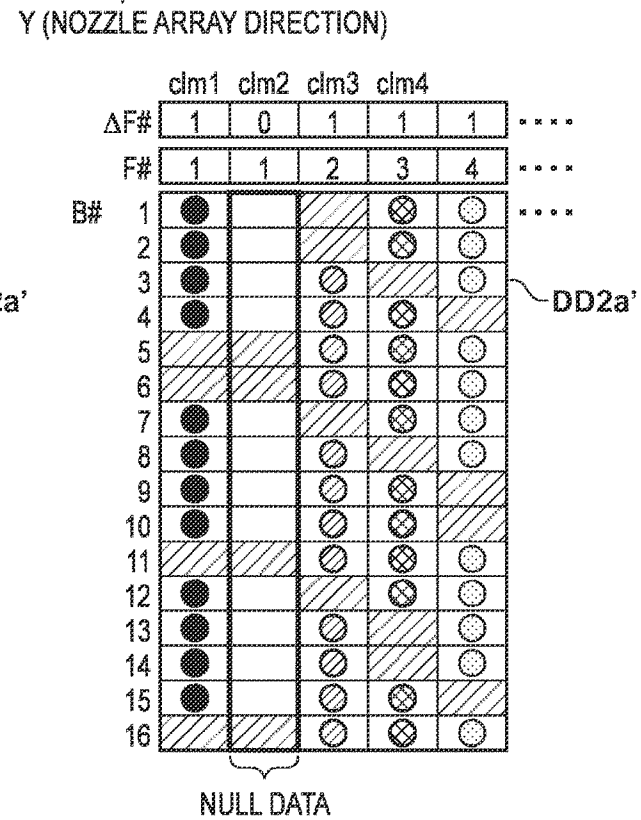

FIGS. 16A to 16D each show the relationship between the flag number, that is, F#1 to F#4 and a driving order TD1*a* or the like in correspondence with the difference number ΔF#, similarly to FIGS. 13A to 13E. More specifically, FIG. 16A shows the relationship between the driving order TD1*a* and the flag number and difference number corresponding to each column. FIG. 16B shows the relationship between print data DD1*a* and the flag number and difference number corresponding to each column. FIG. 16C shows the relationship between a driving order TD1*a*' corresponding to print data DD1*a*' to which null data has been inserted and the corresponding flag number and difference number. FIG. 16D exemplifies the relationship between the print data DD1*a*' to which the null data has been inserted and the corresponding flag number and difference number. Referring to FIGS. 16C and 16D, ΔF#0 is assigned to the column clm2 to which the null data has been inserted, and the flag number is held.

According to this embodiment, it is also possible to obtain the same effects as those in the above-described first embodiment.

4. Modification

Each of the above-described first and second embodiments has exemplified a case in which the block driving order complies with the order of the block numbers for the sake of simplicity. The present invention, however, is not limited to this, and other block driving orders may be adopted. In this example, the block driving order is not the order of block numbers, and complies with shuffled block numbers. Such driving method will also be referred to as "distributed driving" hereinafter. According to this embodiment, it is also possible to obtain the same effects as those in each the above-described embodiments.

FIGS. 17A to 17D each show the relationship between the flag number, that is, F#1 to F#4 and a driving order TD2*a* or the like in a driving method using distributed driving according to this example in correspondence with the difference number ΔF#, similarly to FIGS. 16A to 16D.

The driving order TD2*a* indicates a driving order in the driving method using distributed driving according to this example. For example, with respect to the column clm1 of the nozzle array La, the nozzles of B#5, B#6, B#11, and B#16 are non-driving nozzles, and the remaining nozzles nz are driving nozzles. The driving nozzles are driven in the order of B#1, B#12, B#7, B#2, B#13, B#8, B#3, B#14, B#9, B#4, B#15, and B#10, and the non-driving nozzles of B#5, B#6, B#11, and B#16 are not driven. Similarly, print data DD2*a*, a driving order TD2*a*', and print data DD2*a*' indicate print data in this example, a driving order when null data is inserted, and print data when null data is inserted, respectively.

Distributed driving is advantageous in an inkjet method since the influence of heat energy, generated by driving of the nozzle nz of a given block, on the nozzle nz of an adjacent block is reduced. Note that an example of the driving order of distributed driving has been exemplified but the driving order is not limited to this, and may be changed for, for example, every print job of a predetermined unit, every predetermined column data, or every predetermined period.

5. Others

The two preferred embodiments of the present invention have been exemplified above with reference to a printing apparatus including an inkjet full-line printhead. The present invention, however, is not limited to these embodiments, and the embodiments may partially be changed or their features may be combined in accordance with the purpose or the like.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

In addition, the present invention is applicable to another aspect without departing from the spirit and scope of the present invention. For example, although an inkjet method using heating elements has been exemplified in each of the above-described embodiments, any printing methods such as a method using piezoelectric elements, a method using electrostatic elements, a method using MEMS elements, and other known printing methods may be used.

Furthermore, "printing" can include, in addition to printing of forming significant information such as characters and graphics, printing in a broad sense regardless of whether information is significant or insignificant. For example, "printing" need not be visualized to be visually perceivable by humans, and can also include printing of forming images, figures, patterns, structures, and the like on a printing medium, or printing of processing the medium.

In addition, "printing agent" can include a consumable used for printing in addition to "ink" used in each of the above-described embodiments. For example, "printing agent" can include a liquid which is used to process a printing medium or to process ink (for example, to solidify or insolubilize a colorant in ink applied onto a printing medium) as well as a liquid which is applied onto a printing medium to form images, figures, patterns, and the like.

Furthermore, it is possible to adopt, for example, an arrangement configured to perform printing by applying ink onto an intermediate transfer medium and then transferring the ink onto a printing medium, instead of an arrangement configured to directly apply ink onto a printing medium. It is also possible to use an arrangement configured to perform monochrome printing using one type of ink (for example, black ink), instead of an arrangement configured to perform color printing using a plurality of types of inks.

In addition, "printing medium" can include any media capable of receiving a printing agent, such as cloth, plastic films, metal plates, glass, ceramics, resin, wood, and leather, as well as paper used in general printing apparatuses.

The definition of each term used in this specification for the sake of simplicity should be interpreted without departing from the spirit and scope of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-206671, filed Oct. 7, 2014, which is hereby incorporated by reference herein in its entirety.

What is claimed is:

1. A printing apparatus comprising:

a printing unit including at least two nozzle arrays arranged in a first direction, each nozzle array including a plurality of nozzles arranged along a second direction intersecting the first direction; and a plurality of printing elements provided so as to correspond to the plurality of nozzles of each nozzle array;

a driving unit configured to drive the plurality of printing elements such that ink dots are discharged from the plurality of nozzles of each nozzle array;

a conveying unit configured to convey, in the first direction, a sheet to be printed;

a control unit configured to cause the printing unit to print an image corresponding to print data on the sheet conveyed by the conveying unit, and to print, on the sheet, an adjusting pattern for acquiring a print position shift amount between the at least two nozzle arrays in the first direction at a predetermined interval;

a reading unit configured to read a printing result by the printing unit on the downstream side of a conveying direction of the sheet with respect to the printing unit;

an acquisition unit configured to acquire the print position shift amount based on a result of reading, by the reading unit, the adjusting pattern printed on the sheet while the conveying unit conveys the sheet; and a print data generation unit configured to generate the print data, wherein the print data generation unit performs a first operation of expanding print data onto a memory in correspondence with the first direction and the second direction, a second operation of, for each nozzle array, for every column data corresponding to the second direction in the expanded print data, determining some of the plurality of nozzles as non-discharge nozzles such that positions of the non-discharge nozzles in the second direction do not overlap each other between the at least two nozzle arrays in the first direction, and determining the remaining nozzles of the plurality of nozzles as discharge nozzles, wherein the printing elements corresponding to the discharge nozzles, of the non-discharge nozzles and the discharge nozzles, are activated for printing the image based on the expanded print data, a third operation of determining print data to be assigned to each nozzle array so that printing of dots corresponding to each column data is completed by printing dots discharged from the determined discharge nozzles of each nozzle array, a fourth operation of inserting null data as column data corresponding to the print position shift amount acquired by the acquisition unit to the determined print data, and a fifth operation of distributing the print data to the respective nozzle arrays so as to newly determine discharge nozzles and non-discharge nozzles in response to insertion of the column data of the null data, and print, by the newly determined discharge nozzles, dots corresponding to the print data to which the column data has been inserted.

2. The apparatus according to claim 1, wherein in the fourth operation, when the print position shift amount smaller than a predetermined value, the print data generation unit does not insert the column data of the null data to the print data determined in the third operation.

3. The apparatus according to claim 2, further comprising:

an information holding unit, wherein the information holding unit holds information including a number for specifying discharge nozzles and non-discharge nozzles to be determined by the print data generation unit in the second operation, the driving unit drives the printing elements corresponding to the discharge nozzles of each nozzle array based on the number, and in the fifth operation, the print data generation unit shifts the number if the column data of the null data is not inserted in the fourth operation, and holds the number in accordance with the number of inserted column data if the column data of the null data is inserted in the fourth operation.

4. The apparatus according to claim 3, wherein the information holding unit further holds second information for specifying whether the column data of the null data has been inserted in the fourth operation, and third information for specifying the number of inserted column data if the column data of the null data is inserted.

5. The apparatus according to claim 4, wherein the print data generation unit determines, based on the second information, whether to shift or hold the number, and determines, based on the third information, at least one of a timing at which the number is shifted and a period for which the number is held.

6. The apparatus according to claim 1, wherein when a printhead completes printing based on part of the print data distributed in the fifth operation, the print data generation unit further performs a series of operations from the first operation to the fifth operation for next print data of the print data.

7. The apparatus according to claim 1, wherein the driving unit time-divisionally drives the discharge nozzles of each nozzle array based on the distributed print data.

8. The apparatus according to claim 7, wherein the driving unit sequentially drives the discharge nozzles determined in one of the second operation and the fifth operation in accordance with the determination result.

9. The apparatus according to claim 7, wherein when L (L is an integer not less than 2) represents the number of nozzle arrays, the plurality of nozzles of each nozzle array are divided into N (N is an integer not less than 2) groups each including M (M is an integer not less than 2 and a multiple of L) nozzles, in one of the second operation and the fifth operation, for each nozzle array, the print data generation unit determines M/L nozzles of the M nozzles of each group as the non-discharge nozzles, and determines (M-M/L) nozzles except for the M/L nozzles of each group as the discharge nozzles, and the driving unit time-divisionally drives the (M-M/L) discharge nozzles of each group of each nozzle array.

10. The apparatus according to claim 1, wherein the driving unit drives the respective nozzles of a printhead so as to print, in a region between a first region where at least one image is formed and a second region where at least one next image is formed, the adjusting pattern for acquiring the print position shift amount between the nozzle arrays.

11. The apparatus according to claim 1, wherein a printhead is a full-line print head in which a length of each nozzle array in the second direction is longer than a width of the sheet in the second direction.

12. A driving method for a printing apparatus, the printing apparatus including a printing unit including at least two nozzle arrays arranged in a first direction, each nozzle array including a plurality of nozzles arranged along a second direction intersecting the first direction, and a plurality of printing elements provided so as to correspond to the plurality of nozzles of each nozzle array, a driving unit configured to drive the plurality of printing elements such that ink dots are discharged from the plurality of nozzles of each nozzle array, a conveying unit configured to convey, in the first direction, a sheet to be printed, a control unit configured to cause the printing unit to print an image corresponding to print data on the sheet conveyed by the conveying unit, and to print, on the sheet, an adjusting pattern for acquiring a print position shift amount between the at least two nozzle arrays in the first direction at a predetermined interval, a reading unit configured to read a printing result by the printing unit on the downstream side of a conveying direction of the sheet with respect to the printing unit, and an acquisition unit configured to acquire the print position shift amount based on a result of reading, by the reading unit, the adjusting pattern printed on the sheet while the conveying unit conveys the sheet, the method comprising the steps of:

expanding print data onto a memory in correspondence with the first direction and the second direction;

determining, for each nozzle array, for every column data corresponding to the second direction in the expanded print data, some of the plurality of nozzles as non-discharge nozzles such that positions of the non-discharge nozzles in the second direction do not overlap each other between the nozzle arrays in the first direction, and the remaining nozzles of the plurality of nozzles as discharge nozzles, wherein the printing elements corresponding to the discharge nozzles, of the non-discharge nozzles and the discharge nozzles, are activated for printing the image based on the expanded print data;

determining print data to be assigned to each nozzle array so that printing of dots corresponding to each column data is completed by printing dots discharged from the determined discharge nozzles of each nozzle array;

inserting null data as column data corresponding to the print position shift amount acquired by the acquisition unit to the determined print data; and distributing the print data to the respective nozzle arrays so as to newly determine discharge nozzles and non-discharge nozzles in response to insertion of the column data of the null data, and print, by the newly determined discharge nozzles, dots corresponding to the print data to which the column data of the null data has been inserted.

13. The method according to claim 12, wherein, in the inserting the null data, in a case where the print position shift amount is smaller than a predetermined value, the column data of the null data is not inserted to the determined print data.

14. The method according to claim 13, the printing apparatus further including an information holding unit, wherein the information holding unit holds information including a number for specifying discharge nozzles and non-discharge nozzles in the determining the discharge nozzles and the non-discharge nozzles, the driving unit drives the printing elements corresponding to the discharge nozzles of each nozzle array based on the number, and in the distributing the print data, the number is shifted if the column data of the null data is not inserted in the inserting the null data, and the number is held in accordance with the number of inserted column data if the column data of the null data is inserted in the inserting the null data.

15. The method according to claim 14, wherein the information holding unit further holds second information for specifying whether the column data of the null data has been inserted in the inserting the null data, and third information for specifying the number of inserted column data if the column data of the null data is inserted.

* * * * *